US008713750B2

(12) United States Patent
Fuchigami et al.

(10) Patent No.: US 8,713,750 B2
(45) Date of Patent: May 6, 2014

(54) DRY-TYPE CLEANING CHASSIS AND DRY-TYPE CLEANING DEVICE

(75) Inventors: Akihiro Fuchigami, Kanagawa (JP); Yoichi Okamoto, Kanagawa (JP); Kohji Tsukahara, Kanagawa (JP); Shozo Murata, Kanagawa (JP); Yuusuke Taneda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 356 days.

(21) Appl. No.: 13/284,073

(22) Filed: Oct. 28, 2011

(65) Prior Publication Data

US 2012/0117749 A1 May 17, 2012

(30) Foreign Application Priority Data

Nov. 17, 2010 (JP) ..... 2010-257203
Jul. 11, 2011 (JP) ..... 2011-153243

(51) Int. Cl.
*A47L 7/00* (2006.01)

(52) U.S. Cl.
USPC ..... 15/345; 15/330; 15/302

(58) Field of Classification Search
USPC ..... 15/345, 346, 300.1, 306.1, 309.1, 15/309.2, 302, 330
See application file for complete search history.

(56) References Cited

U.S. PATENT DOCUMENTS

| | | | | |
|---|---|---|---|---|
| 5,562,779 | A * | 10/1996 | Allaway et al. | 134/10 |
| 5,964,956 | A * | 10/1999 | Straub et al. | 134/15 |
| 6,474,355 | B1 * | 11/2002 | Jirawat et al. | 15/306.1 |
| 7,111,797 | B2 * | 9/2006 | Bezama et al. | 239/522 |
| 7,552,503 | B2 * | 6/2009 | Wakao et al. | 15/302 |
| 7,743,776 | B2 | 6/2010 | Okamoto et al. | |
| 7,758,700 | B2 | 7/2010 | Fuchigami et al. | |
| 7,854,648 | B2 | 12/2010 | Satoh et al. | |
| 2007/0107752 | A1 | 5/2007 | Fuchigami et al. | |
| 2008/0052953 | A1 | 3/2008 | Okamoto et al. | |
| 2009/0314312 | A1 | 12/2009 | Fuchigami et al. | |
| 2010/0307535 | A1 | 12/2010 | Fuchigami et al. | |
| 2011/0067731 | A1 | 3/2011 | Satoh et al. | |

FOREIGN PATENT DOCUMENTS

| | | |
|---|---|---|
| JP | 60-188123 | 9/1985 |
| JP | 4-83567 | 3/1992 |
| JP | 2009-226394 | 10/2009 |
| JP | 2010-69368 | 4/2010 |
| JP | 2010-167419 | 8/2010 |

* cited by examiner

*Primary Examiner* — Dung Van Nguyen
(74) *Attorney, Agent, or Firm* — Cooper & Dunham LLP

(57) ABSTRACT

A dry-type cleaning chassis includes a chassis part including an opening part in contact with a cleaning target, an air inlet duct provided to blow external air into the internal space; a suction port provided for generating a circulating air flow in the internal space by suctioning air having been introduced into the internal space via the air inlet duct; a porous unit configured to pass objects removed from the cleaning target to a suction port side; and a path limiting member formed of a cylindrical shape extended in an axis center direction of the circulating air flow and configured so that an inside of the cylindrical shape is in communication with the suction port as a suction path.

14 Claims, 20 Drawing Sheets

FIG.5
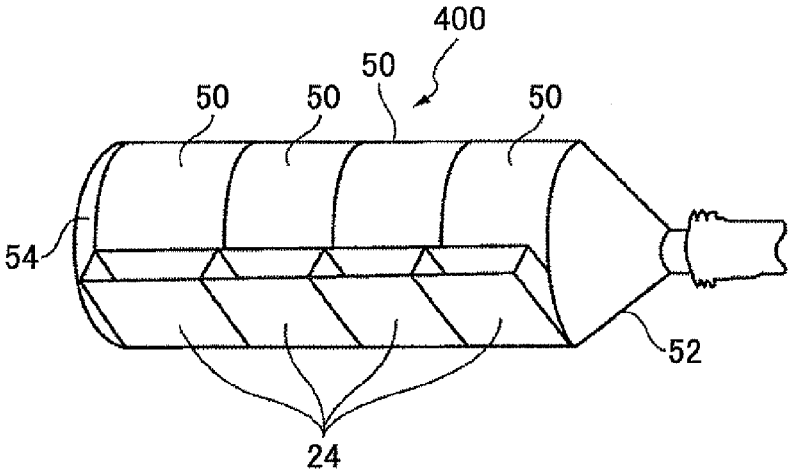
FIG.6A
FIG.6B
FIG.6C
FIG.6D
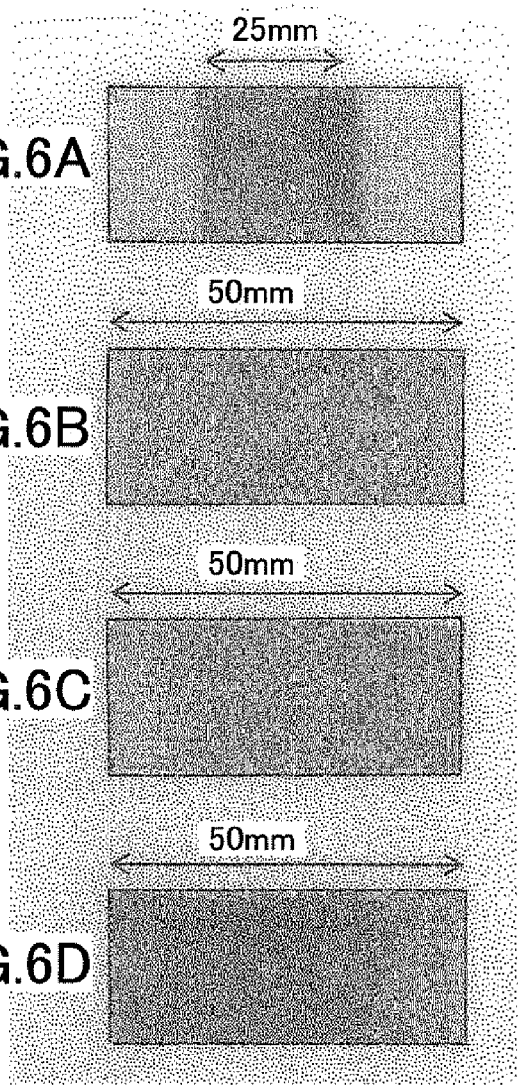

DRY-TYPE CLEANING CHASSIS AND DRY-TYPE CLEANING DEVICE

CROSS-REFERENCE TO RELATED APPLICATIONS

The present application claims priority under 35 U.S.C §119 to Japanese Patent Application Nos. 2010-257203 filed Nov. 17, 2010, and 2011-153243 filed Jul. 11, 2011, the entire contents of which are hereby incorporated herein by reference.

BACKGROUND OF THE INVENTION

1. Field of the Invention

The present invention generally relates to a dry-type cleaning device for cleaning by flying cleaning media and contacting or colliding the cleaning media with cleaning targets. More particularly, the present invention relates to a dry-type cleaning device that cleans the cleaning targets by contacting the cleaning media with any part of the cleaning targets, a dry-type cleaning chassis used in the dry-type cleaning device, and a dry-type cleaning method using the dry-type cleaning device.

For example, the present invention may be used for removing flux adhered to a masking fixture which may be called a dip pallet or a carrier pallet used in a process using a flow solder bath. Particularly, the present invention may be adapted to remove the flux adhered to narrow areas such as side surfaces of the cleaning targets and the vicinity of openings.

2. Description of the Related Art

Recently, fixtures for masking the regions other than the regions where soldering is to be performed have been widely used in the soldering process using a flow solder bath. Those masking fixtures (a.k.a. the dip pallet and the carrier pallet), however, are required to be periodically cleaned so as to avoid the degradation of the masking accuracy which may be degraded by the flux accumulated on the surface of the masking fixtures.

Typically, such cleaning may be performed by dipping the fixture into a solvent. Therefore, a larger amount of solvent may be required to be used. As a result, the cost may be increased and the operator's workload may be heavy. There is a known technique to spray the solvent onto the cleaning objects without dipping. This method, however, may not overcome the problem that a larger amount of solvent is required.

To overcome the problem, there has been known a dry-type cleaning device that cleans the cleaning targets by contacting flying cleaning media with the cleaning targets. Japanese Patent Application Publication Nos. 4-83567 and 60-188123 (Patent Documents 1 and 2, respectively) disclose a cleaning method for cleaning the cleaning targets by flying the cleaning media in the circumferential direction in a cylindrical container (chassis) by the circulating air flow of compressed air and colliding the flying cleaning media with the cleaning targets disposed at the opening formed on the side surface of the cylindrical container. However, in this method, the circulating air flow is caused by the compressed air. Because of this feature, when the cleaning targets are separated from the opening of the container (i.e. cleaning device), some of the cleaning media may leak through the opening.

To overcome this problem, in Patent Document 1, a net member is provided at the opening to prevent the leakage of the cleaning media. However, due to the net member, the energy of the cleaning media when the cleaning media collid with the cleaning targets may be reduced. Further, the cleaning media may be stopped by the net member. As a result, the cleaning performance may be reduced.

Further, in Patent Document 2, a cap member that caps the opening is provided to prevent the leakage of the cleaning media through the opening. This cap member, however, may cause an operator to promptly operate the cap member upon separating the cleaning targets from the opening. As a result, extra workload and attention may become necessary, the device may have to have a complicated mechanism, the operation of the cleaning device may become much more difficult, and the cleaning device may be more likely to be broken.

For related art, reference may be made to Japanese Laid-open Patent Publication No. 2009-226394.

SUMMARY OF THE INVENTION

According to an aspect of the present invention, there is provided a dry-type cleaning chassis for cleaning a cleaning target by colliding cleaning media with the cleaning target, the cleaning media being flown (blown) by an air flow. The dry-type cleaning chassis includes a chassis part including an internal space where the cleaning media are to be flown; an opening part in contact with the cleaning target, so that the cleaning media collide with the cleaning target; an air inlet duct through which external air flows into the internal space; a suction port provided for generating a circulating air flow in the internal space by suctioning air having been introduced into the internal space via the air inlet duct; a porous unit passing objects removed from the cleaning targets to a suction port side; and a path limiting member being formed of a cylindrical shape extended in an axis center direction of the circulating air flow and being configured so that an inside of the cylindrical shape is in communication with the suction port as a suction path. Further, the chassis part is divided into plural regions in the axis center direction, and the plural regions independently contain the cleaning media.

BRIEF DESCRIPTION OF THE DRAWINGS

Other objects, features, and advantages of the present invention will become more apparent from the following description when read in conjunction with the accompanying drawings, in which:

FIG. 5 is an oblique view of a configuration including plural dry-type cleaning chassis connected to each other;

FIGS. 6A through 6D are picture images illustrating experimental results of visualizing the cleaning performance of various cleaning chassis;

DETAILED DESCRIPTION OF THE PREFERRED EMBODIMENTS

To overcome at least one of the problems in the dry-type fixing device of the related art, the Applicant of the present invention has filed an invention of a dry-type cleaning device under Japanese Patent Application No. 2010-175687. In the dry-type cleaning device, a suctioning unit is provided to be connected to a chassis of the dry-type cleaning device, so that when an opening of the chassis is disposed at the cleaning targets, slice-like cleaning media are flown by a circulating air flow generated by air flowing from the outside of the chassis into the chassis through an air path of the suction unit and the cleaning media remain within the chassis by providing, for example, a net-like porous unit that passes air and dust in the chassis but does not pass the cleaning media, so that the circulation flying of the cleaning media can be continued by the circulating air flow.

According to this dry-type cleaning device, when the opening of the chassis is separated from the cleaning targets, the circulating air flow may disappear because the internal pressure at the opening becomes substantially equal to the atmospheric pressure, and due to the negative pressure caused by suctioning air, much air is introduced into the chassis through the opening. As a result, the cleaning media remain in the chassis by being adsorbed on the porous unit and do not leak from the opening.

Figure 17A:
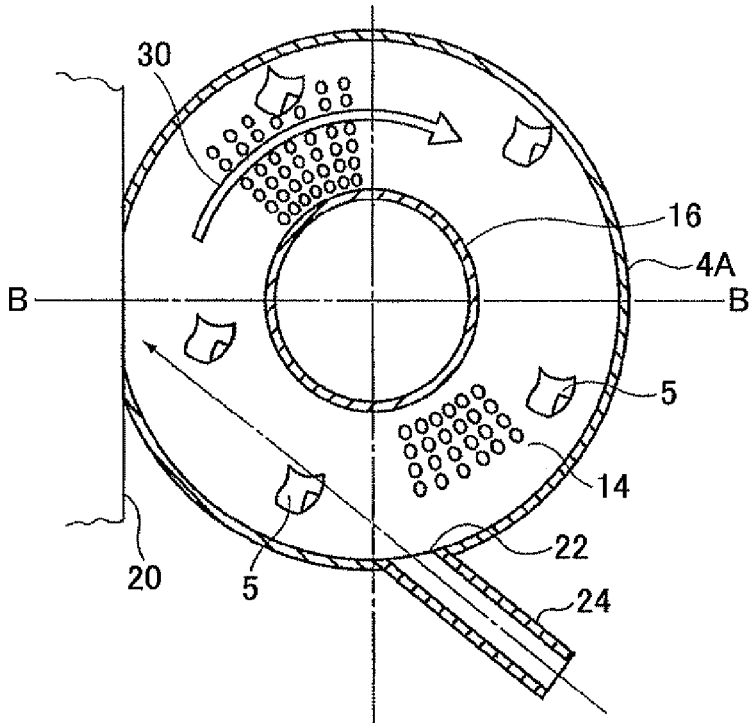
FIGS. 17A and 17B are schematic cross-sectional views of a dry-type cleaning device which is based of the present invention.
Figure 17B:
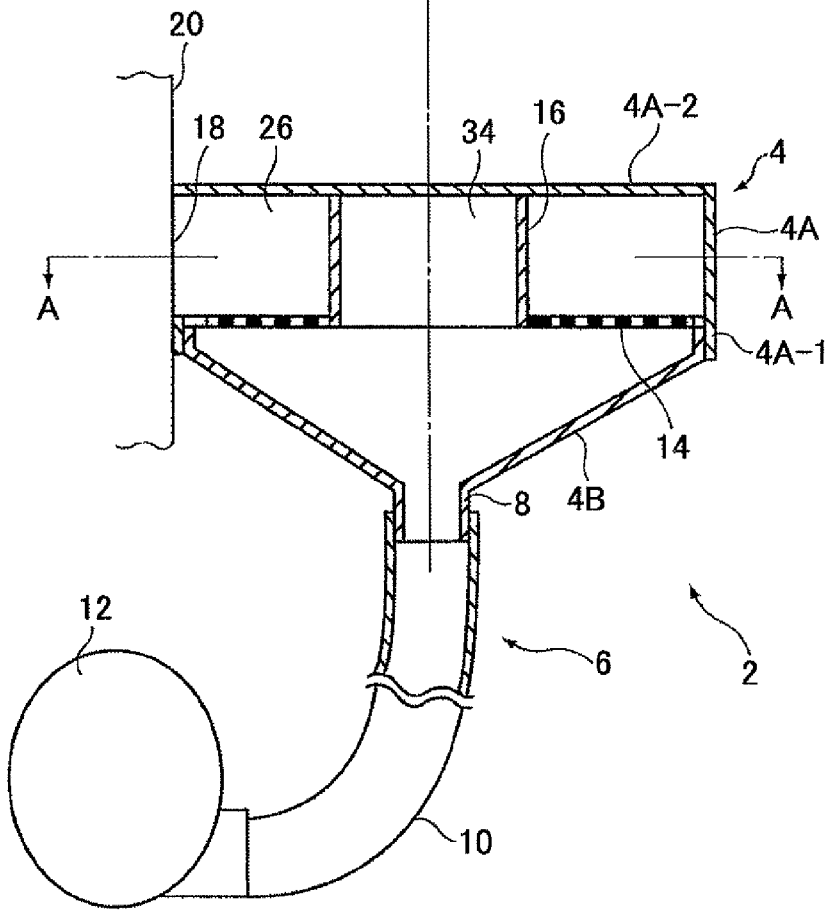

According to the prior invention of the applicant of the present invention, as schematically illustrated in FIGS. 17A and 17B, the suction unit 6 is used to suction air in the chassis 4, the opening part 18 is in contact with the cleaning target 20 to close the opening part 18, a negative pressure is generated in the chassis 4, so that external air flows into the chassis at high speed to generate circulating air flow 30 to fly the cleaning media 5, so that the cleaning media 5 can collide with the surface to be cleaned of the cleaning targets 20 to perform cleaning. In this case, the cross-section of the path of the circulating air flow 30 is limited by the path limiting member 16.

Before the opening part 18 is closed, the cleaning media 5 are adsorbed on the separation plate 14 as the porous unit by the suctioning operation of the suction unit 6 so as to remain in the chassis 4.

According to this configuration, an operator may hold the device and move the chassis 4 easily. Further, the operator may easily place the opening part 18 at a pinpoint of the desired part of the cleaning target 20 to clean the cleaning target 20. Therefore, the degree of freedom may become higher. On the other hand, however, the area to be cleaned in one cleaning process may be limited to an area substantially equal to the area of the opening part 18. Therefore, to clean a wide area, it may be necessary to frequently move the device, which may increase the operator's workload.

To make it possible to clean a wide area at the same time while maintaining the degree of freedom (usability) in cleaning, it may be necessary to increase the size of the opening part 18. To that end, from the principle of cleaning, it may be preferable to increase the size of the opening part 18 in the direction parallel to the rotating direction of the circulating air flow. Herein, this direction may be referred to as axis center direction. However, when the dry-type cleaning chassis 4 is simply extended in the axis center direction, the cleaning media 5 may not fly to the area opposite to the area where the separation plate 14 is disposed at the bottom surface (one end in the axis center direction) of the chassis 4. As a result, the cleaning performance at the area opposite to the area where the separation plate 14 is disposed may be reduced. Namely, as a whole, uneven cleaning may occur.

As described above, in the dry-type cleaning device described above, the cleaning media 5 is adsorbed on and held at the separation plate 14 until the opening part 18 is closed, and the cleaning media 5 are separated from the separation plate 14 and are flown when the opening part 18 is closed. Because of this feature, in an area farther from the separation plate 14, the cleaning media 5 are less likely to fly.

Further, when sizes of the chassis 4 and the opening part 18 are increased, it may be necessary to increase the number (amount) of cleaning media 5. However, even when the sizes of the chassis 4 and the opening part 18 are increased, the area of the separation plate 14 may not be increased. Therefore, in the area farther from the separation plate 14, effects of flying and adsorbing the cleaning media 5 may become insufficient. As a result, the cleaning media 5 that have not been adsorbed on the separation plate 14 may be more likely to leak from the opening part 18.

Further, plural chassis may be arranged in series in the axis center direction. However, as illustrated in FIGS. 17A and 17B, the chassis 4 includes an upper chassis 4A generating the circulating air flow and a lower chassis 4B to be connected to the suction unit 6 (adsorbing unit) in the axis center direction. Therefore, when plural chassis 4 are to be arranged in series in the axis center direction, the lower chassis may interfere the connection between two upper chassis 4A.

Therefore, plural chassis (more specifically, the plural upper chassis 4A) may not be directly connected to each other without leaving any space therebetween. Namely, the dry-type cleaning chassis may not be adequately applied to clean a wider area at the same time by connecting plural chassis.

The present invention is made in light of the above problems, and may provide a dry-type cleaning chassis that cleans a wide area at the same time and has a degree of freedom in cleaning operations without causing uneven cleaning and leakage of the cleaning media from the chassis, and a dry-type cleaning device including the dry-type cleaning chassis.

To that end, according to an embodiment of the present invention, the lower chassis is no longer necessary for each chassis (i.e., upper chassis) by using the path limiting member to define the suction path, the path limiting member limiting the cross-section of the path of the circulating air flow. By doing this, it becomes possible to arrange plural chassis in the axis center direction and to increase the size of the opening part.

The definitions of the terms used herein are described.

The term "chassis" used herein refers to a container-like structure having a space where a circulating air flow is likely to be generated in the structure. The term "space where a circulating air flow is likely to be generated" refers to a space having a shape including a continuous inner surface so that air can circulate along the inner surface of the space. More preferably, the space has a shape including a rotating-body-shaped inner surface or inner space.

The term "air flow path" used herein refers to a unit that allows air to flow in a certain direction and typically has a tube shape and a smooth inner surface. Further, the "air flow path" may also refer to a path formed by using a plate-like path limiting plate having a smooth surface when air can flow along the surface and air flowing direction is determined.

In addition to a general case where air flows linearly, in a case where air flows in a gentle curve having a low flow path resistance, a certain air flowing direction may also be determined. However, unless otherwise described, the term "direction of the air flow path" refers to the direction of air flow blowing out at an air flow inlet. Further, herein, the air flow path having a straight tube shape, having one end connected to the air flow inlet, and having another end as an air taking inlet open to the atmosphere of the outside of the chassis may refer to an "inlet". Generally, the inlet includes a smooth inner surface having a low fluid resistance and has a circular, rectangular, or slit-shaped shape to be cross section.

Further, herein, the term "circulating air flow" refers to a flow accelerated at the position of the air flow inlet by an incoming flow and flowing by changing the flowing direction along the inner surface of the chassis, returns to the position of the air flow inlet, and joins with the incoming flow. Generally, the circulating air flow may be generated by flowing (introducing) air in the tangential direction of the inner wall in a closed space having a continuous (endless) inner wall.

In the following, embodiments of the present invention are described with reference to the accompanying drawings.

First, with reference to FIGS. 17A through 19, a configuration and operations of a dry-type cleaning device according to a prior invention of the applicant of the present invention is described.

Further, the studies that are based on the prior invention and that have led to the present invention are described with reference to FIGS. 20 through 24.

With reference to FIGS. 17A and 17B, a configuration of a handy-type dry-type cleaning device 2 as a base technology of the present invention is described. FIG. 17A is a horizontal cross-sectional view cut along the line A-A of FIG. 17B, and FIG. 17B is a vertical cross-sectional view cut along the line B-B of FIG. 17A.

As illustrated in FIGS. 17A and 17B, the dry-type cleaning device 2 includes a dry-type cleaning chassis (hereinafter may be simplified as a "chassis") 4 having a flying space (space) of cleaning media 5 in the chassis and a suctioning unit 6 that generates a negative pressure in the chassis 4. The chassis 4 includes an upper chassis 4A having a cylindrical shape and a lower chassis 4B having an inverted conical shape. The upper chassis 4A and the lower chassis 4B are integrated with each other to constitute the chassis 4. The chassis 4 is not limited to a specific size. For example, preferably, the diameter of the chassis 4 may be in a range from about 10 mm to about 300 mm so that an operator may find it easy to handle.

Herein, the terms "upper" and "lower" are used for explanatory purposes in the figures. Therefore, for example, in actual use, the device may not be used based on the terms "upper" and "lower".

Figure 20:
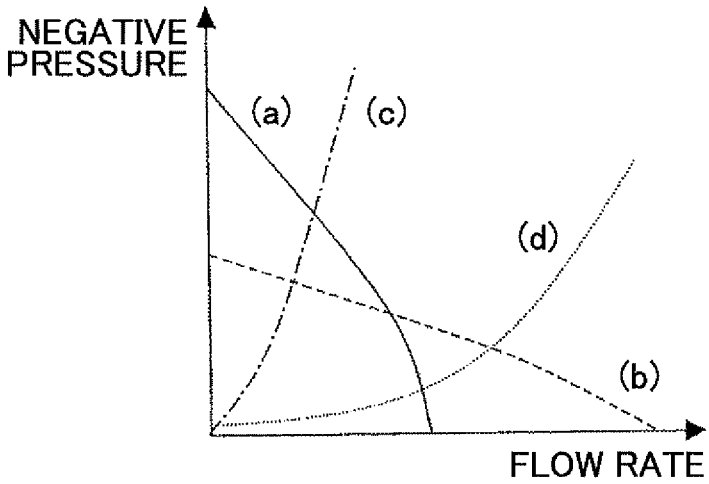
FIG. 20 is graphs illustrating relationships between a negative pressure and a flow rate.

As illustrated in FIG. 17A, a suction port 8 is integrally connected to the top of the conical shape of the lower chassis 4B so as to function as a suction duct. As illustrated in FIG. 17B, a suction unit 6 includes a suction hose 10 and a suction device 12. One end of the suction hose 10 is connected to the suction port 8, and the other end of the suction hose 10 is connected to the suction device 12. The cross-sectional area of the suction port 8 is substantially the same as that of the suction hose 10, and is not limited to have a specific value. Preferably, the cross-sectional area is in a range from about 100 $mm^2$ to about 10000 $mm^2$. Optimum cross-sectional area is selected based on, for example, the size of the dry-type cleaning device 2 and the specifications of the suction device 12. As the suction device 12, a vacuum cleaner for domestic use, a vacuum motor, a vacuum pump, or a device indirectly generating a low pressure or a negative pressure by pumping liquid may be used. The suction device 12 may have characteristics as illustrated in FIG. 20 having a decreasing trend (i.e., when the negative pressure increases the flow rate increases, and when the negative pressure decreases, the flow rate decreases). Depending on the type, the suction device 12 has the characteristics of line (a) or line (b) of FIG. 20.

Further, depending on the shape of the dry-type cleaning device 2, the dry-type cleaning device 2 has the characteristics of line (c) or line (d). Generally, when the dry-type cleaning device 2 has the characteristics of line (c), the suction device 12 having the characteristics of line (a) is selected. On the other hand, when the dry-type cleaning device 2 has the characteristics of line (d), the suction device 12 having the characteristics of line (b) is selected. Herein, the terms "upper surface", "bottom surface" and the like are used for illustration purposes only.

Referring back to FIG. 17B, the upper chassis 4A includes an engage concave part 4A-1 at the bottom surface part of the upper chassis 4A. The engage concave part 4A-1 is detachably engaged with the upper end part of the lower chassis 4B. The upper surface 4A-2 of the upper chassis 4A is sealed. For explanatory purposes, it is described that the upper chassis 4A is engaged with the lower chassis 4B. However, the present invention is not limited to this configuration. Any other appropriate method which fixes the positional relationships between the upper chassis 4A and the lower chassis 4B and seals the upper surface 4A-2 may be used. Such method includes, for example, a method using screws, pins, glue or the like. In a boundary area between the upper chassis 4A and the lower chassis 4B at the bottom surface part of the upper chassis 4A, a porous separation plate 14 is provided as a porous unit. The separation plate 14 is a plate member having holes of a punched metal. The size of the holes of the separation plate 14 is determined so as to prevent the movement of the cleaning media 5 to the lower chassis 4B side during the suctioning. More specifically, the diameter of the holes of the separation plate 14 is selected in a range, for example, from 0.1 mm to 10 mm. In FIG. 17A, the display of some parts of the separation plate 14 is omitted. Further, the size of the cleaning media 5 is increased for explanatory purposes.

As the porous unit, any appropriate porous matter may be used as long as the matter does not pass the cleaning media 5 and passes air and dirt (i.e., matter removed from the cleaning targets). For example, a slit plate, a net or the like may be used. Further, as material of the porous unit, any appropriate material may be used as long as the material has smooth surfaces. For example, resin, a metal or the like may be used.

The porous unit is disposed so that the surface of the porous unit is substantially orthogonal to the central axis of the circulating air flow. By doing this, air flows along the surface of the porous unit, which may prevent the stagnation of the cleaning media 5 at the porous unit.

To reduce the attenuation of the circulating air flow and the stagnation of the cleaning media 5, it may be preferable that the inner surface in the chassis is flat and smooth without unevenness.

The cleaning media 5 adsorbed on the surface of the porous unit may be flown again by disposing the porous unit along the surface substantially parallel to the direction of the circulating air flow.

The material of the chassis 4 is not limited to a specific material. It may be preferable that a metal such as aluminum, stainless or the like is used to reduce the adhesion of foreign matter and the dissipation by the friction with the cleaning media. Further, a material made of resin may also be used as long as the material is durable against the friction.

In the center part in the upper chassis 4A, a flow path limiting member 16 having a cylindrical shape is provided as a part of the chassis 4. The flow path limiting member 16 has the same cylindrical axis as that of the upper chassis 4A. Further, the lower end of the flow path limiting member 16 is fixed to the separation plate 14.

The flow path limiting member 16 is provided for squeezing the flow cross-sectional area of the circulating air flow so as to in improve the flow speed of the circulating air flow. Namely, by having the flow path limiting member 16, a ring-shaped space that allows the circulating air flow to flow (move) in the space is formed. In other words, a space where the cleaning media is flown is formed.

It should be noted that it is not always necessary that the central axis (cylindrical axis) of the flow path limiting member 16 is the same as that of the upper chassis 4A. Namely, the central axis (cylindrical axis) of the flow path limiting member 16 may be different from that of the upper chassis 4A as long as such a ring-shaped space can be formed.

Figure 1B:
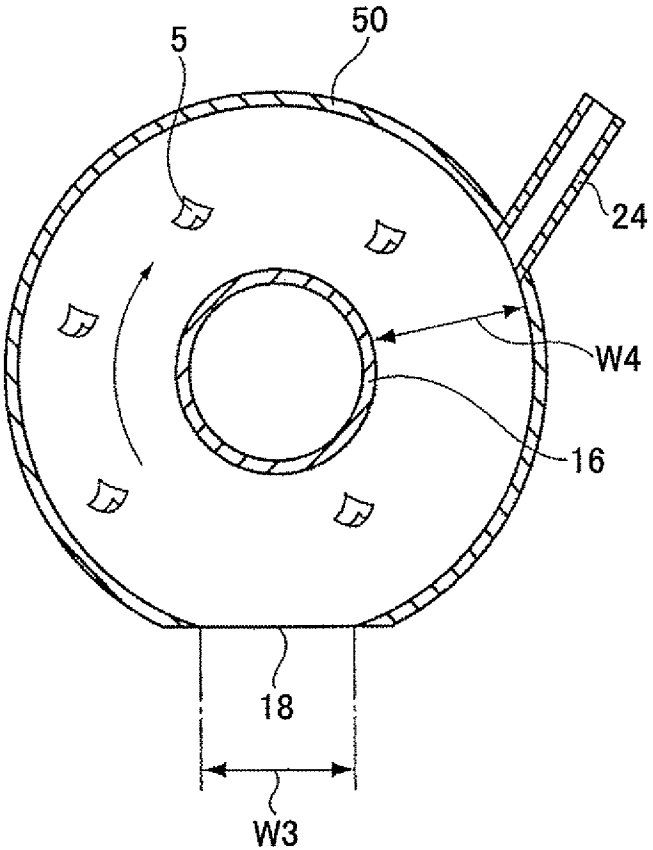
FIGS. 1A and 1B are cross-sectional views of a dry-type cleaning chassis according to a first embodiment of the present invention.
Figure 21:
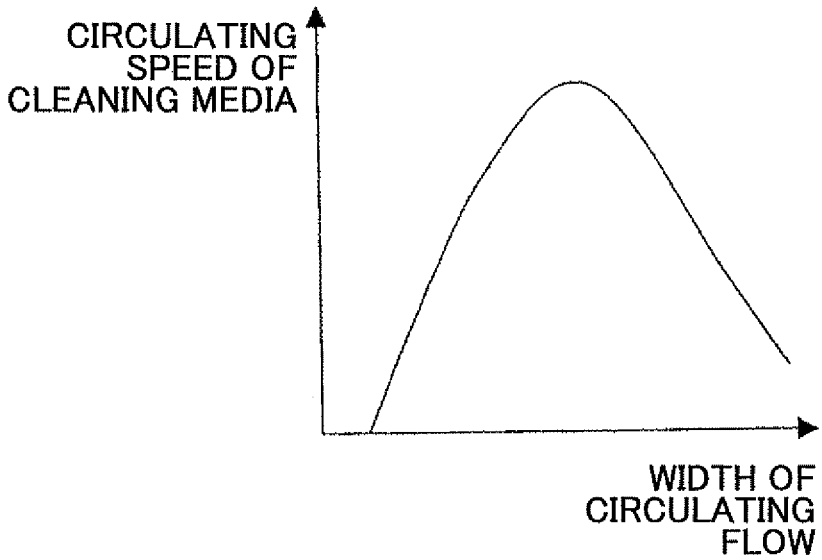
FIG. 21 is a graph illustrating a relationship between a circulating speed of cleaning media and circulated path width.

The flow path limiting member 16 is not limited to have a specific size. However, as illustrated in FIG. 1B, it may be necessary to have an appropriate circulating path width W4 so as to avoid the congestion and the clogging of the cleaning media 5. Further, as illustrated in FIG. 21, when the circulating path width W4 becomes narrower, the circulating speed of the cleaning media 5 may be reduced due to crowded cleaning media 5. On the other hand, when the circulating path width W4 becomes wider, the path cross-sectional area is increased. As a result, the flow speed may be reduced, and namely, the circulating speed of the cleaning media 5 may also be reduced. Therefore, it may be preferable that the circulating path width W4 is in a range from about 5 mm to 50 mm depending on the size and the amount of the cleaning media 5 provided in the upper chassis 4A.

Further, at one part of the side surface of the upper chassis 4A, an opening part 18 is formed. The opening part 18 is provided so that the cleaning media 5 flown by the circulating air flow can be in contact with or collide with the cleaning target through the opening of the opening part 18.

As described above, basically, the upper chassis 4A has a cylindrical shape. However, by forming the opening part 18, the upper chassis 4A comes to have a shape as illustrated in, for example, FIG. 17B. Namely, the upper chassis 4A has a shape so that the outer circumferential part other than the opening part 18 can largely escape (be separated) from the cleaning target 20. As a result, it may become possible to improve the degree of freedom of local contact with the cleaning target 20 (i.e., pinpoint cleaning).

The opening part 18 has a shape formed by cutting the side surface of the upper chassis 4A by a flat cross-sectional surface parallel to the cylindrical axis of the upper chassis 4A. Therefore, when viewed from the direction orthogonal to the cylindrical axis, the shape of the opening part 18 is rectangular.

Further, at another part of the side surface of the upper chassis 4A, an air intake port 22 is formed. Further, an inlet (i.e., air inlet duct) 24 as a circulating air flow generation unit and as a ventilation path is externally connected to the upper chassis 4A in a manner such that external air can be introduced in the upper chassis 4A through the inlet 24 and the air intake port 22. Further, the central axis (i.e., the ventilation (air flow) direction) of the inlet 24 is set so as to be substantially parallel to the separation plate 14. The ventilation direction of the inlet 24 is inclined relative to the radial direction of the upper chassis 4A, so that when the central axis of the inlet 24 is extended, the extended central axis of the inlet 24 reaches the opening part 18.

Figure 22:
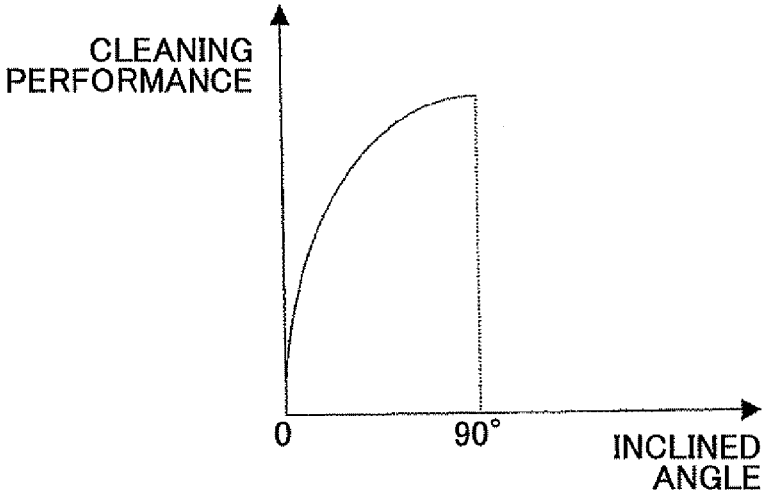
FIG. 22 is a graph illustrating a relationship between cleaning performance and inclination angle.

The inclined angle of the inlet 24 relative to the opening part 18 is not limited to a specific angle. However, it is thought that the inclined angle be substantially equal to the impact angle at which the cleaning media 5 collide with the cleaning target 20. Therefore, if the cleaning media 5 are collided with the cleaning target 20 at an angle close to the horizontal, the impact energy may be dispersed. FIG. 22 illustrates the relationship between the inclined angle and the cleaning performance. As illustrated in FIG. 22, the cleaning performance becomes highest when the inclined angle is 90 degrees, and when the inclined angle decreases, the cleaning performance is also decreased.

Figure 23:
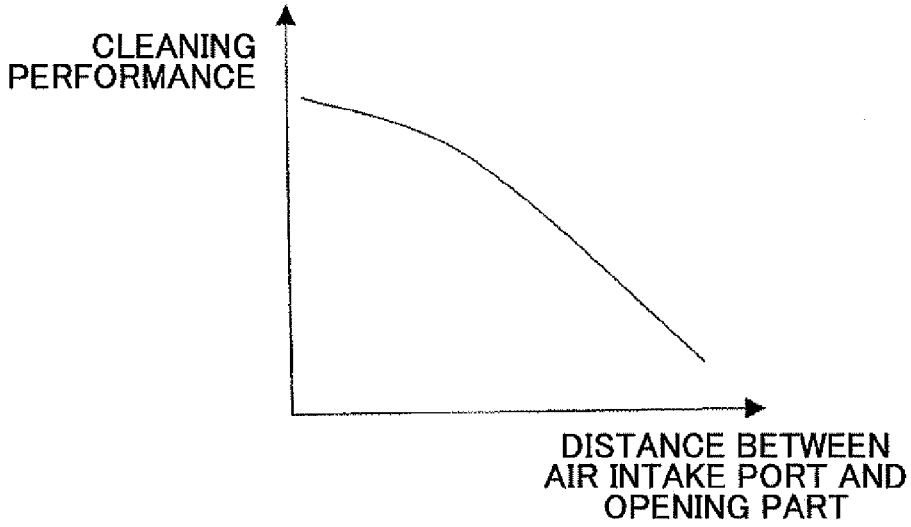
FIG. 23 is a graph illustrating a relationship between the cleaning performance and a distance from an air flow inlet to an opening part.

FIG. 23 illustrates a relationship between the cleaning performance and the distance between the air intake port 22 and the opening part 18. As illustrated in FIG. 23, the shorter the distance between the air intake port 22 and the opening part 18, the higher the cleaning performance becomes.

Therefore, it may be preferable that the position of the inlet 24 is determined based on the balance between the above two characteristics (conditions). Further, it may be preferable that the size of the air intake port 22 is determined so that the flow speed at the air intake port 22 is in a range from about 50 m/s to about 150 m/s. The flow speed (m/s) may be easily determined based on the following formula:

$$\text{Flow Speed } V(\text{m/s}) = \text{Suction Flow Rate } Q(\text{m}^3/\text{s}) / \text{Area of Air Intake Port } S(\text{m}^2)$$

When the flow speed has a value other than a value in the above range, the energy efficiency of the cleaning media 5 may be reduced and the cleaning performance may be reduced.

The inlet 24 has a width extending in the height direction of the upper chassis 4A. Only one inlet 24 having the diameter or width less than the height of the upper chassis 4A may be provided. Alternatively, plural units of the inlet 24 may be arranged in the height direction of the upper chassis 4A.

Further, an appropriate size of the air intake port 22 may change depending on the desired suction flow rate. To respond to the change, air flow path forming members (air flow path width changing members) having different opening areas may be exchangeably provided. By changing the size of the air intake port 22 in response to the suction flow rate by selecting an appropriate air flow path forming member, it may become possible to easily obtain the appropriate flow speed (details are given in a third embodiment described below).

Due to the circulating air flow generated by forming a closed space, the cleaning media 5 adsorbed on the separation plate 14 may be blown up and fly again.

Further, the size of the opening part 18 is large enough so that, when the opening part 18 is released (i.e., when the opening part 18 is separated from the cleaning target 20), the internal pressure at the opening part 18 becomes substantially equal to atmospheric pressure. Similarly, the opening part 18 is disposed at a position where when the opening part 18 is released, the internal pressure at the opening part 18 is more likely to equal a pressure value substantially equal to the atmospheric pressure.

By having the configuration as described above, while the dry-type cleaning device 2 is not in contact with the cleaning target 20, the internal pressure at the opening part 18 becomes substantially equal to atmospheric pressure so that the differential pressure between the internal pressure and the external pressure is reduced. As a result, the amount of air flowing into the upper chassis 4A through the opening of the opening part 18 is remarkably reduced. On the other hand, the amount of air flowing into the upper chassis 4A is increased. As a result, it may become possible to prevent the leakage of the cleaning media 5 from the chassis 4.

Further, the amount of air flow while the opening part 18 is released may become two times or three times greater than the amount of air flow while the opening part 18 is sealed. Therefore, while the opening part 18 is released, the slice-shaped cleaning media 5 are adsorbed on the porous unit (separation plate 14) and do not fly to be leaked from the chassis 4.

The size of the opening part 18 may be sufficient to have an area two or three times greater than that of the air intake port 22 so as not to be influenced by the air intake port 22. When the width of the opening part 18 in the axis center direction of the upper chassis 4A is substantially equal to the width of the upper chassis 4A in the axis center direction, the width of the opening part 18 in the direction orthogonal to the axis center direction may become two or three times greater than that of the air intake port 22.

Further, when the height of the upper chassis 4A is increased without changing the suction unit 6, it may be necessary to reduce the size of the air intake port 22 in order to maintain the flow speed of air through the air intake port 22. In addition, it may become necessary to reduce the width of the opening part 18 in the direction orthogonal to the axis center direction.

By doing in this way, the sealing level of the chassis 4A may be increased while the opening part 18 is sealed. Also, the leakage of the cleaning media 5 may be prevented while the opening part 18 is released from the cleaning target 20.

The cleaning media 5 herein refer to an assembly of sliced cleaning piece. Further, herein, the cleaning medium 5 refers to a unit of the sliced cleaning piece.

The sliced cleaning medium 5 herein refers to a slice of material having an area equal to or less than 100 $mm^2$. The material of the cleaning medium 5 may be a film having durability such as polycarbonate, polyethyleneterephthalate, acryl, cellulose resin and the like. The thickness of the cleaning medium may be in a range from 0.02 mm to 0.2 mm. However, depending on the cleaning target 20, it may be effective when the thickness, the size, or the material of the cleaning media is changed. Namely, any of the various kinds of the cleaning medium may be used in the present invention. Therefore, it should be noted that the limitations described above for the cleaning media are examples only, and the cleaning medium used in embodiments of the present invention is not limited to the cleaning medium described above.

Further, the material of the cleaning medium is not limited to resin. Namely any appropriate material having a slice shape and light weight so as to be easily blown such as a slice of paper, cloth, mica, mineral, ceramics, glass, a metallic foil or the like may be used.

Figure 24:
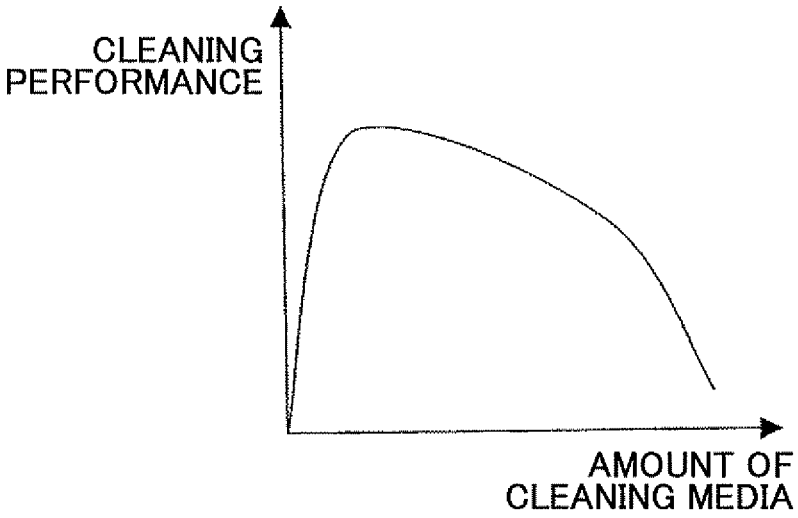
FIG. 24 is a graph illustrating a relationship between the cleaning performance and an amount of the cleaning media.

An appropriate amount of cleaning media 5 to be provided in the dry-type cleaning device 2 may be determined based on the capacity of an internal space 26. As illustrated in FIG. 24, when the amount of the cleaning media 5 is less than the appropriate amount, the frequency that the cleaning media 5 collide with the cleaning target 20 may be reduced, and as a result, the cleaning performance is reduced. On the other hand, when the amount of the cleaning media 5 is greater than the appropriate amount, the cleaning media 5 in the internal space 26 interfere with each other, and as a result, a necessary circulating speed may not be obtained, thereby reducing the cleaning performance.

Further, whether the cleaning media 5 can be blown easily may depend on the shape of the cleaning media 5 as well. Therefore, the appropriate amount of cleaning media 5 to be provided in the dry-type cleaning device 2 may vary depending on the shape of the cleaning media 5.

As described above, there may exist the appropriate amount of the cleaning media 5 in the internal space 26. Therefore, when it is necessary to increase the length (width) of the dry-type cleaning device, it may become possible to prevent the uneven distribution of the cleaning media 5 by partitioning the internal space 26 into plural spaces by using dividing plates so that the cleaning media 5 may not be moved to another space. By doing this, it may become possible to reduce uneven cleaning.

Herein, the internal space 26 has a ring shape in the upper chassis 4A, so that the cleaning media 5 in the internal space 26 can be blown by the rotating air flow and be in contact with or collide with the cleaning target 20 facing the opening part 18. On the other hand, in an internal space 34 formed by the flow path limiting member 16 and the like, there is no circulating air flow.

Figure 18B:
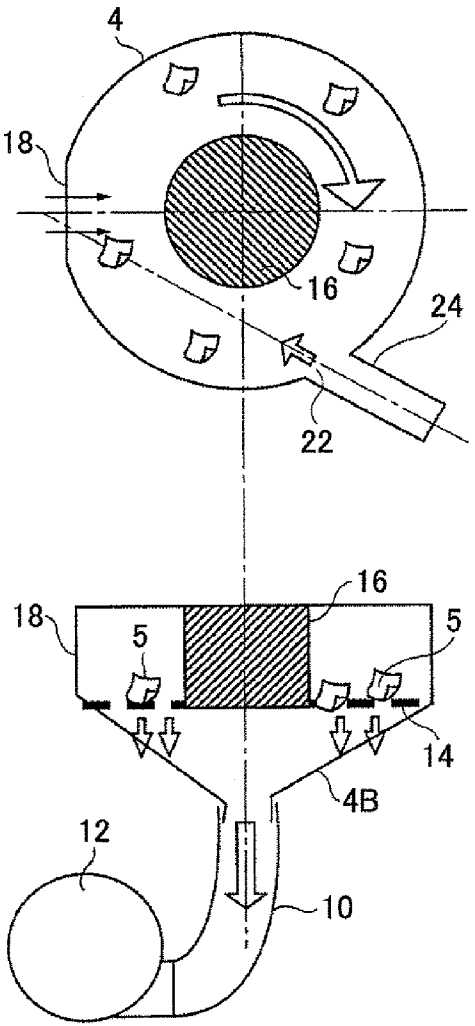
FIGS. 18A through 18B illustrate a cleaning operation of the dry-type cleaning device.
Figure 18A:
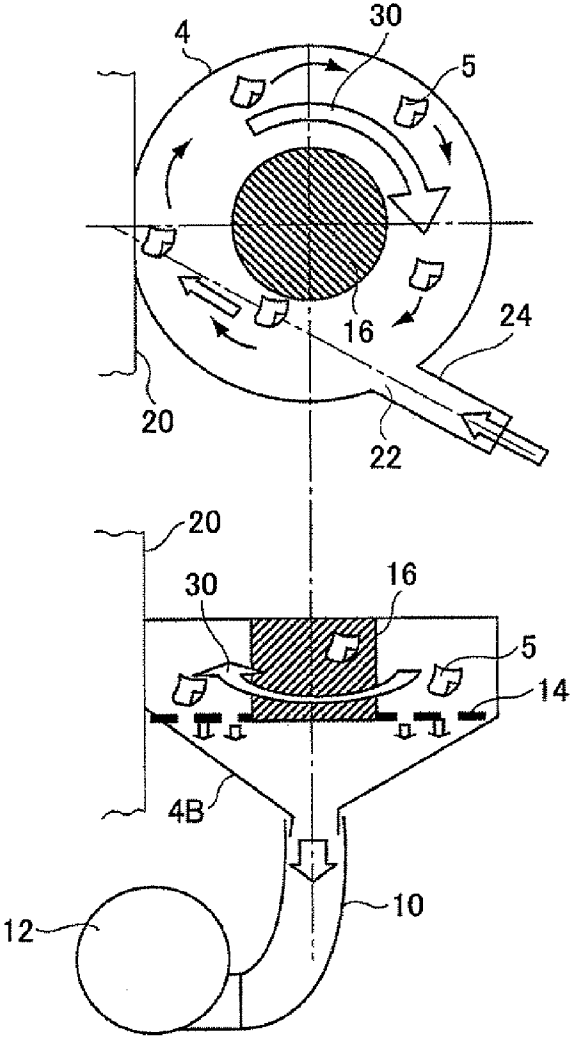

Next, a cleaning operation performed by the dry-type cleaning device 2 having the above configuration is described with reference to FIGS. 18A and 18B. In FIGS. 18A and 18B, the thickness of the elements and the like are not accurately depicted and the hatching is displayed in the internal space 34 as a quiet space so as to be understood easily. FIG. 18B illustrates a case where the opening part 18 is separated from the cleaning targets 20 so that air is suctioned while the opening part 18 is released. On the other hand, FIG. 18A illustrates a case where the opening part 18 is disposed at the position of the cleaning targets 20 and sealed.

Before starting the cleaning operation, the cleaning media 5 are provided (supplied) into the chassis 4. The cleaning media 5 having been supplied into the chassis 4 are adsorbed on the separation plate 14 as illustrated in FIG. 18B and stored in the chassis 4.

In the case, due to the suctioning operation by the suction unit 6, a negative pressure is generated in the chassis 4. Therefore, air outside the chassis 4 may flow into the chassis 4 through the inlet 24. However, in this case, the flow speed and the flow rate of the air flow in the inlet 24 are small. As a result, the circulating air flow 30 generated in the chassis 4 may not become strong enough to blow up the cleaning media 5 having been adsorbed on the separation plate 14.

When the cleaning media 5 are supplied and stored in the chassis 4, as illustrated in FIG. 18A, the opening part 18 is in contact with the area to be cleaned on the surface of the cleaning target 20, so as to form a sealed state.

When the opening part 18 is sealed, air suctioning flow through the opening of the opening part 18 is stopped. As a result, the negative pressure in the chassis 4 is rapidly increased, and both the amount and the flow rate of air suctioned through the inlet 24 are increased. Then, the air flow defined by the inlet 24 flows out from the output port of the inlet (i.e., the air intake port 22) into the chassis as a high-speed air flow.

Due to the air flowing out from the air intake port 22, the cleaning media 5 stored on the separation plate 14 are blown up and fly to the surface of the cleaning target 20 facing the opening part 18.

The air flow becomes the circulating air flow 30 flowing along the inner wall of the chassis to form a ring-like air flow. However, some part of the air flow passes through the holes of the separation plate 14 due to being suctioned by the suction unit 6.

When the circulating air flow 30 flowing in the chassis 4 in a ring shape described above is returned to the position near the air intake port 22 of the inlet 24, the circulating air flow 30 is combined with and accelerated by the air flow from the inlet 24. Therefore, in fact, as the circulating air flow 30, a spiral air flow flowing from the upper surface 4A-2 to the separation plate 14 is generated. As described above, the stable circulating air flow 30 may be formed in the chassis 4.

The cleaning media 5 are circulated in the chassis 4 by the circulating air flow 30, so that the cleaning media 5 may repeatedly collide with the surface of the cleaning target 20. Due to the impact by the collision, stains on the surface of the cleaning target 20 are separated from the surface in the form of fine particles or powder.

The separated stain particles are discharged outside of the chassis 4 by passing through the holes of the separation plate 14 by the suction unit 6.

The rotational axis of the circulating air flow 30 formed in the chassis 4 is orthogonal to the surface of the separation plate 14. Therefore, the circulated air flow 30 is flowing in the direction substantially parallel to the surface of the separation plate 14.

Therefore, the circulating air flow 30 blows the cleaning media 5 adsorbed on the separation plate 14 in the lateral direction and flows between the cleaning media 5 and the separation plate 14, so as to pull up the cleaning media 5 from the separation plate 14 to blow up the cleaning media 5 again.

Further, when the opening part 18 is sealed, the negative pressure in the upper chassis 4A is increased to be close to the negative pressure in the lower chassis 4B. Therefore, the adsorbing force adsorbing the cleaning media 5 to the surface of the separation plate 14 may be reduced, which may make it easier for the cleaning media 5 to fly again.

The circulating air flow 30 is likely to become a fast air flow because of being accelerated in a steady direction, which may also assist the fast flying movement of the cleaning media 5 in the chassis 4. While the cleaning media 5 are flying in the fast air flow rotating at high speed, the cleaning media 5 are unlikely to be adsorbed on the separation plate 14 and the stain particles attached to the cleaning media 5 are likely to be separated from the cleaning media 5 due to the centrifugal force applied to the stain particles.

Figure 19:
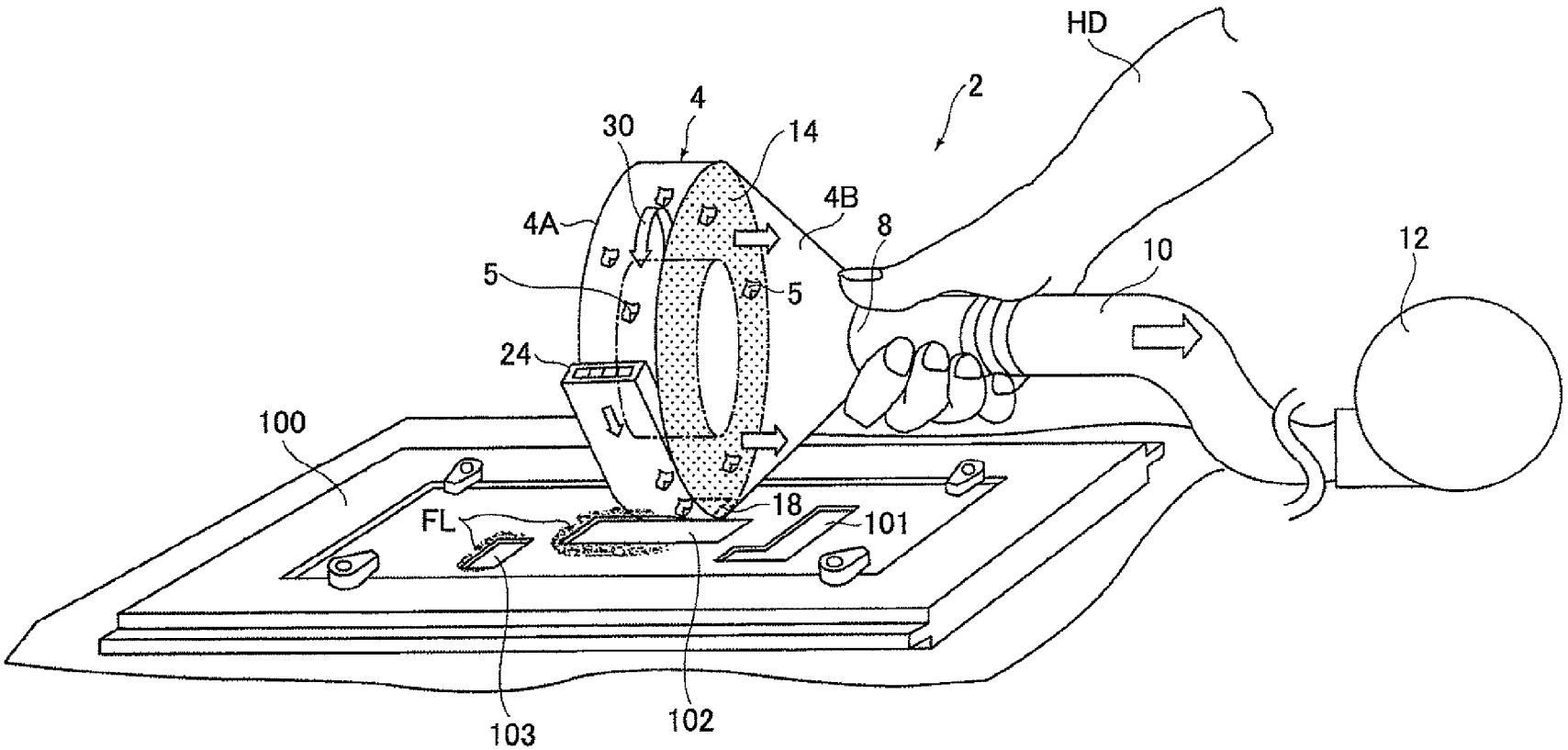
FIG. 19 is a drawing illustrating an example usage of the dry-type cleaning device.

FIG. 19 illustrates a case where the dry-type cleaning device 2 described above is used. In this example, the dry-type cleaning device 2 removes the stains near the mask opening parts 101 through 103 of the dip pallet 100 used in a process using the flow solder bath. Flux to be removed is accumulated and adhered near the holes of the mask opening parts 101 through 103.

In this case, as illustrated in FIG. 19, the base portion near the suction port 8 is held by a hand HD. Then, while air is suctioned by the suction device 12, the opening part 18 of the chassis 4 is pressed to the portion to be cleaned.

Before the opening part 18 is pressed to the portion to be cleaned, air in the chassis 4 is suctioned and the cleaning media 5 are adsorbed on the separation plate 14. Therefore, even though the opening part 18 direction is downward, the cleaning media 5 are prevented from being leaked from the chassis 4.

Also, after the opening part 18 is pressed to the portion to be cleaned, the sealed state of the chassis is formed. Therefore, no cleaning media 5 may be leaked from the opening of the opening part 18.

When the opening part 18 is pressed to the portion to be cleaned, an amount of air flowing through the inlet 24 is remarkably increased. As a result, the strong circulating air flow 30 is generated in the chassis 4 and blows up the cleaning media 5 adsorbed on the separation plate 14, so that the cleaning media 5 can collide with the flux FL adhered and fixed to the portion to be cleaned to remove the flux FL.

A cleaning operator may hold the base portion near the suction port 8 and move the position of the cleaning device 2 relative to the dip pallet 100 so as to sequentially move the cleaning device 2 on the portions to be cleaned to remove all the flux FL adhered and fixed to the portions to be cleaned.

In the state of FIG. 19, the peripheral area of the mask opening part 101 of the dip pallet 100 has been cleaned, and the peripheral areas of the mask opening parts 102 and 103 have not been cleaned yet.

In the cleaning operation, even when the opening part 18 is separated from the portions to be cleaned while the opening part 18 is moved relative to the portions to be cleaned, the cleaning media 5 are unlikely to be leaked from the chassis 4 as described above. As a result, the number (amount) of the cleaning media 5 is maintained or hardly reduced, thereby enabling substantially maintaining the cleaning performance.

The cleaning media 5, however, may be gradually damaged by, for example, the repeated collisions with the cleaning target 20. In this case, the damaged cleaning media 5 along with the flux (i.e. stains) removed from the cleaning target 20 (e.g., the dip pallet 100) may be collected by the suction device 12. Therefore, the number (amount) of the cleaning media 5 stored in the chassis 4 may be gradually reduced.

In such a case, additional cleaning media 5 may be supplied into the chassis 4.

Next, a dry-type cleaning chassis according to a first embodiment of the present invention is described with reference to FIGS. 1 through 10. Throughout the following descriptions of the embodiments of the present invention, the same reference numerals are used for denoting the same elements in the configuration described above, and repeated description thereof may be omitted. FIG. 1 illustrates a chassis 50 in the first embodiment. The chassis 50 corresponds to the upper chassis 4A. The path limiting member 16 has a hollow circular cylindrical structure. Further, the length L in the axis center direction is less than the chassis width W1 in the same direction.

Further, the separation plates 14 are extended in a conical shape from the edges of the path limiting member 16 to the respective edges of the chassis 50. Namely, the separation plates 14 are disposed so as to be pulled into the inside of the chassis 50 in the axis center direction from the respective edges of the chassis 50. First edges of the separation plates 14 are fixed to the respective edges of the path limiting member 16, and second edges of the separation plate 14 are fixed to the respective edges of the chassis 50. By having this configuration, the width W2 of the opening part 18 in the axis center direction is substantially equal to the width W1.

Figure 1A:
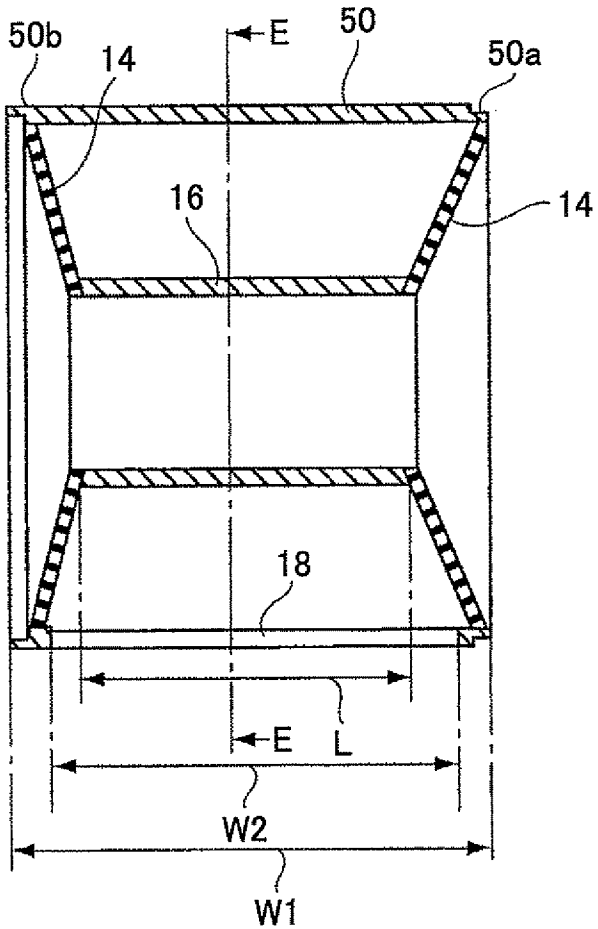

Further, as schematically illustrated in FIG. 1A, a concave engage section 50*a* having a protruding section on the inner peripheral side and a receding section on the outer peripheral side is formed at one edge portion of the chassis 50 in the axis center direction. Similarly, a convex engage section 50*b* having the protruding section on the outer peripheral side and the receding section on the inner peripheral side is formed at the other edge portion of the chassis 50 in the axis center direction.

Figure 2:
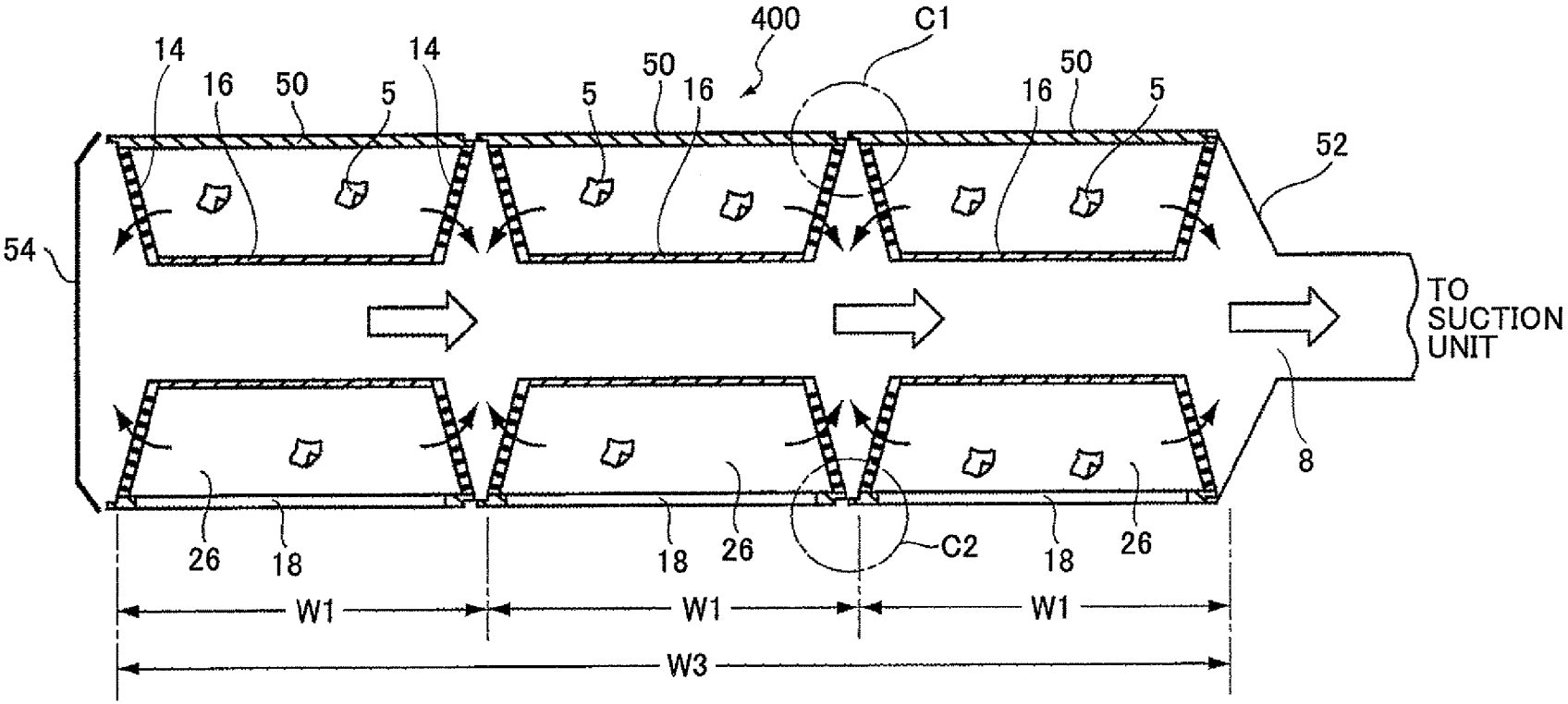
FIG. 2 is a cross-sectional view of a configuration including plural dry-type cleaning chassis connected to each other.

Further, as illustrated in FIG. 2, a suction cover 52 having the suction port 8 engages the concave engage section 50*a* that can engage the convex engage section 50*b* on the right-hand side of FIG. 2. On the other hand, a termination cover 54 engages the convex engage section 50*b* that can engage the concave engage section 50*a*. Further, when the suction unit 6 is connected to the suction port 8 of the suction cover 52, the dry-type cleaning device similar to the dry-cleaning device 2 is configured.

In this case, the path limiting member 16 serves as the suction path in communication with the suction port 8, so as to be suctioned by the suction unit 6.

The chassis 50 in this embodiment refers to a sectional chassis (unit chassis) having engagement mechanisms at both edge portions. Therefore, by connecting plural chassis 50 in the axis center direction, the size of the chassis 50 and the total area of the openings of the opening parts 18 may be easily increased.

FIG. 2 illustrates a case where three sectional chassis 50 are connected. For explanatory purposes, the suction cover 52 and the termination cover 54 are illustrated in a simple manner, and the engage parts between the chassis 50 are separated.

Figure 3:
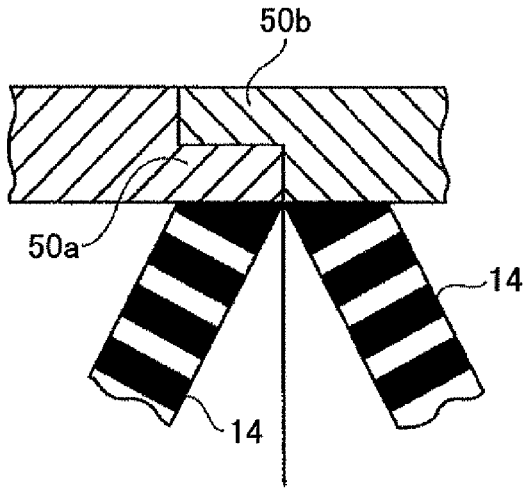
FIG. 3 is an enlarged cross-sectional view of part C1 in FIG. 2.
Figure 4:
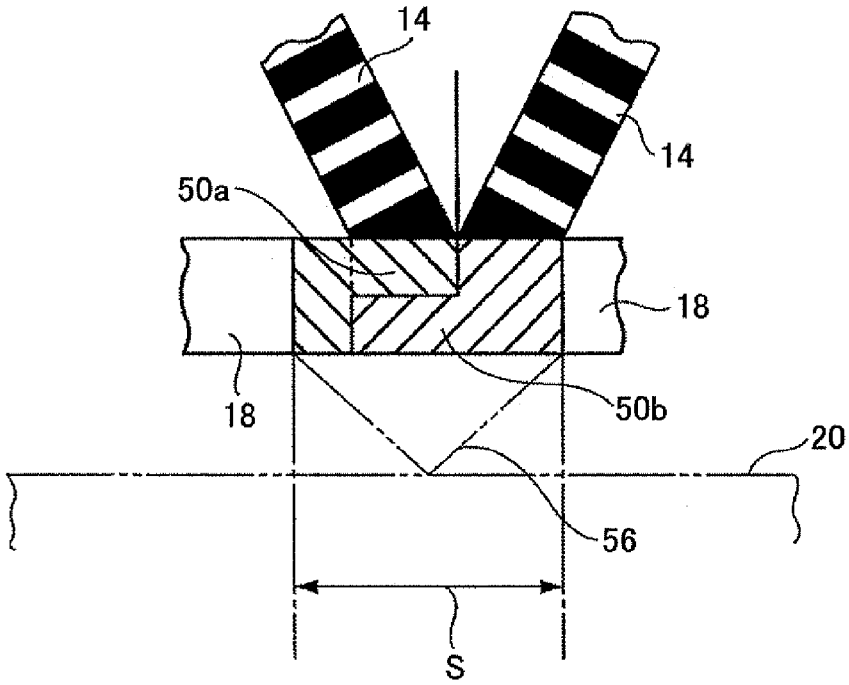
FIG. 4 is an enlarged cross-sectional view of part C2 in FIG. 2.

The width W3 of the connected chassis 400 in the axis center direction is three times as long as the width of a single chassis 50. In the same manner, the total area of the openings of the opening parts 18 of the connected chassis 400 is substantially three times as large as the area of the opening of the opening part 18 of a single chassis 50. FIG. 3 is an enlarged view of the part C1 of the engage part. FIG. 4 is an enlarged view of the part C2 of the other engage part. FIG. 5 is a perspective view of the connected chassis 400 of FIG. 2 (the number of the connected chassis 50 is four, increased by one from the configuration of FIG. 2).

In FIG. 2, when air is suctioned by the suction unit 6, the path limiting members 16 form a continuous suction path, and the negative pressure is generated in the internal spaces 26. Then, when the opening parts 18 are sealed by the cleaning targets 20, fast air flow is introduced through the inlets 24, and the circulating air flow is generated. Due to the circulating air flow, the cleaning media 5 fly. The mechanism of the cleaning by the cleaning media 5 is the same as that described above.

The width W3 may be easily increased by adding the number of the chassis 50 serving as the sectional chassis. By doing this, the area of the openings of the opening parts 18 may accordingly be enlarged.

In each of the chassis 50, the cleaning function described above is performed independently. Therefore, even when a large number of chassis 50 are connected to increase the width W3 of the connected chassis 400, for example, the cleaning media 5 may fly and be adsorbed on the separation plates 14 in substantially the same manner regardless of the number of chassis 50.

Therefore, the problem that the cleaning media 5 in an area far from the separation plate 14 do not desirably fly and the cleaning performance in the area is reduced and uneven cleaning is observed may not occur. However, the longer the width of the connected chassis 400 becomes, the greater the path cross-sectional area in the internal spaces 26 becomes and the slower the circulating flow speed becomes. As a result, the cleaning performance may be reduced. However, in this case, it may be possible to maintain the path cross-sectional area in the internal spaces 26 by reducing the outer diameter of the connected chassis 400. By doing this, it may become possible to maintain the cleaning performance by maintaining the circulating flow speed even when the width of the connected chassis 400 is increased.

In the above description in this embodiment, a case is described where the separation plates 14 having a conical shape and serving as dividing plates as well are fixed at the both edge portions of the path limiting members 16. However, the separation plates 14 on the termination cover 54 side in the chassis 50 may be flat plane plates having no separation function. Further, the flat plane plates may be plates extending in the direction orthogonal to the axis center direction without extending so as to form the conical shape.

When the flat plane surface is used, it is preferable to reduce the thickness of the flat plane plates so as not to disturb the function of the opening parts 18 (i.e., so as not to enlarge the non-cleaning areas between the openings of the opening parts 18). In this case, the function of the flat plane plates is to avoid the movement of the cleaning media 5 through the flat plane plates. Therefore, any plate may be used as the flat plane plate as long as the plate has the above function.

Further, when a porous flat plane plate is used, air may flow along the connected chassis 400, thereby enabling reducing the variation of the circulating flow speeds among the chassis 50 of the connected chassis 400 and the uneven cleaning (details are described in the third embodiment below).

However, to achieve higher cleaning performance and reduce the uneven cleaning, it may be more effective when the porous separation plates 14 having the conical shape are used because of their higher suction efficiency.

As illustrated in FIG. 2, by providing the separation plates 14 on the respective edge portions of the path limiting member 16, the cleaning media 5 may be separately adsorbed on two separation plates 14 when the opening parts 18 are released. Namely, the number of the cleaning media 5 to be adsorbed on one separation plate 14 may be reduced.

This configuration may be help generate a more uniform distribution of the cleaning media 5 in the axis center direction in the internal spaces 26 when the openings of the opening parts 18 are sealed and circulating air flow is generated. This means that, due to the above configuration, uneven cleaning in the axis center direction for each chassis 50 may be remarkably reduced.

Further, by having the configuration that the separation plates 14 are disposed so as to be pulled into the inside of the chassis 50 in the axis center direction from the respective edges of the chassis 50, the interference structure in connecting the chassis 50 may be reduced. As a result, it may become possible to easily connect one chassis 50 with another chassis 50 and to effectively extend the width of the openings of the opening parts 18 in the axis center direction.

As illustrated in FIG. 4, the width S at the connecting section is much less than the width W3 of the connected chassis 400. However, due to the width S, the continuity of the opening parts 18 in the axis center direction may not be maintained. Namely, the portion where the continuity is not maintained may not be cleaned. The uncleaned areas may be cleaned by slightly moving the connected chassis 400 in the axis center direction during or after the cleaning operation.

To structurally clean the uncleaned areas, as illustrated as the v-shaped dashed-two dotted lines in FIG. 4, protrusions 56 having a V-shaped cress-sectional area and being in point contact with the cleaning targets 20 when the chassis 50 are connected to each other may be provided so that the protrusions 56 surround the peripheries of the openings of the opening parts 18.

Figure 7:
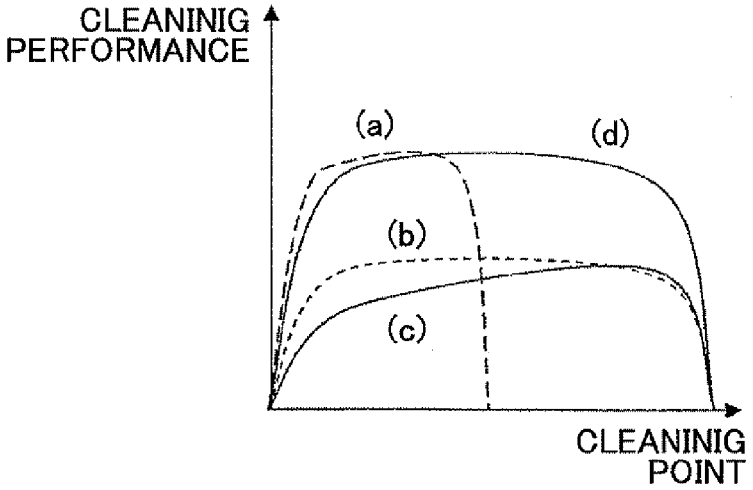
FIG. 7 is graphs illustrating the characteristics of the picture images of FIGS. 6A through 6D.

FIGS. 6A through 6D are picture images of experimental results in visualizing the cleaning performances of various cleaning chassis 50. Those picture images are formed by cleaning a pressure-sensitive sheet for ten seconds, the pressure-sensitive sheet being fixed to a resin plate, so as to display the impacted points generated by the collision of the cleaning media with the pressure-sensitive sheet, and scanning the image of the impacted points with a scanner. The darker the part of the picture image is, the higher the density of the impact points of the area is, namely the more the cleaning media 5 have collided, and the higher the cleaning performance is. FIG. 7 illustrates graphs (a) through (d) illustrating the respective cases of FIGS. 6A through 6D.

FIG. 6A illustrates results using the cleaning chassis of FIGS. 1A and 1B having the following configuration (hereinafter "both sides separation 25 mm type").

Outer diameter of chassis 4: 100 mm
Outer diameter of path limiting member 16: 60 mm
Height of chassis 4 (=W1): 25 mm
Size of opening part 18: (W1) 25 mm×(W3 see FIG. 1B) 25 mm
Amount of cleaning media 5: 1 g FIG. 6B illustrates results using the cleaning chassis of FIGS. 1A and 1B having the following configuration (hereinafter "both sides separation 50 mm type"). Namely, the length of the chassis in the axis center direction is greater than that of the chassis in FIG. 6A.

Outer diameter of chassis 4: 100 mm
Outer diameter of path limiting member 16: 60 mm
Height of chassis 4 (=W1): 50 mm
Size of opening part 18: (W1) 50 mm×(W3) 25 mm
Amount of cleaning media 5: 2 g FIG. 6C illustrates results using the cleaning chassis having the same configuration of the chassis of FIG. 6B except that the holes of the one of the two separation plates 14 (i.e., the holes of the separation plate 14 on the termination cover side) are sealed, so that only one of the two separation plates can serve as the separation plate 14 (hereinafter "one side separation 50 mm type").

FIG. 6D illustrates results using the cleaning chassis of FIG. 1 having the following configuration (hereinafter "compact both sides separation 50 mm type"). Namely, the outer diameters of the chassis 4 and the path limiting member 16 are less than those in the chassis of FIG. 6B.

Outer diameter of chassis 4: 50 mm
Outer diameter of path limiting member 16: 30 mm
Height of chassis 4 (=W1): 50 mm
Size of opening part 18: (W1) 50 mm×(W3) 25 mm
Amount of cleaning media 5: 1 g In FIGS. 6A through 6D, the right-hand side represents a suction port side, and the left-hand side represents a termination cover side. Further, the right and left direction (i.e., the horizontal direction) represents the axis center direction.

As illustrated in FIG. 6C, in the "one side separation 50 mm type", more impact points are present on the separation plate side. Namely, uneven cleaning is observed. Further, the area of the separation plates in this "one side separation 50 mm type" is less than that in the "both sides separation 50 mm type". Therefore, the amount of the cleaning media 5 that may be adsorbed on and stored on the separation plates 14 is reduced. As a result, the cleaning performance may be reduced. Further, when the cleaning chassis is separated from the cleaning target (in this case, the pressure-sensitive sheet), some of the cleaning media 5 could not be contained in the chassis and were scattered in the vicinity of the pressure-sensitive sheet. This is because the cleaning media 5 far from the separation plate 14 are unlikely to be adsorbed on the separation plate 14.

As illustrated in FIG. 6B, in the "both sides separation 50 mm type", when the cleaning chassis is separated, some of the cleaning media 5 were not stored and scattered. However, the amount of the scattered cleaning media 5 in this "both sides separation 50 mm type" was less than that in the "one side separation 50 mm type". This means that when the length of the chassis is equal to or greater than a certain length, it may become difficult to substantially store (contain) all the cleaning media 5 when the opening part 18 is separated.

However, when the path limiting member 16 has a porous shape and air in the chassis can be suctioned by the suction unit 6, the cleaning media 5 could be stored (contained) on the path limiting member 16 and scattered cleaning media 5 were hardly observed.

Further, the cleaning performance in the "both sides separation 50 mm type" was less than that in the "both sides separation 25 mm type". This may be due to the increase of the area of the opening part (i.e., the increase of the area to be cleaned).

As illustrated in FIG. 6D, in the "compact both sides separation 50 mm type", the capacity (size) of the internal space 26 is reduced. Due to this change, when compared with the chassis described with reference to FIGS. 17 through 19, the area of the opening part 18 (i.e., the area to be cleaned) may be increased while maintaining the cleaning performance.

Figure 8A:
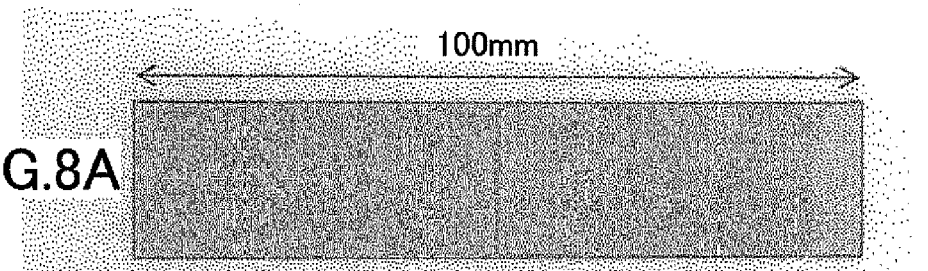
FIGS. 8A through 8C are picture images illustrating experimental results of visualizing the cleaning performance of several configurations including plural cleaning chassis connected to each other.
Figure 8B:
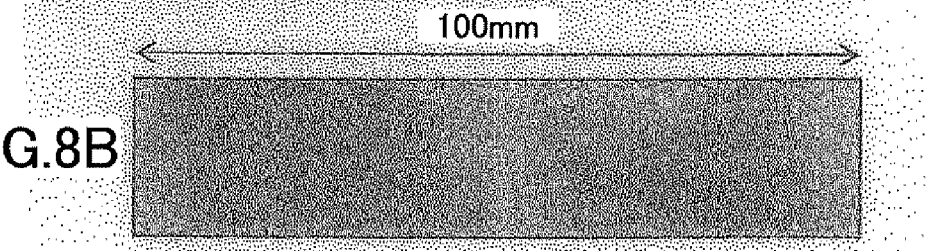
Figure 8C:
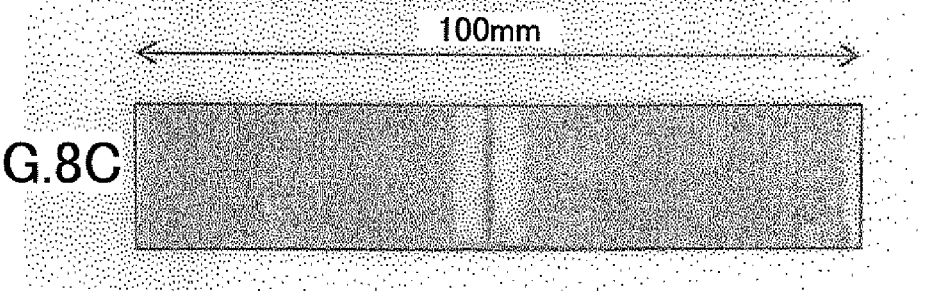
Figure 9:
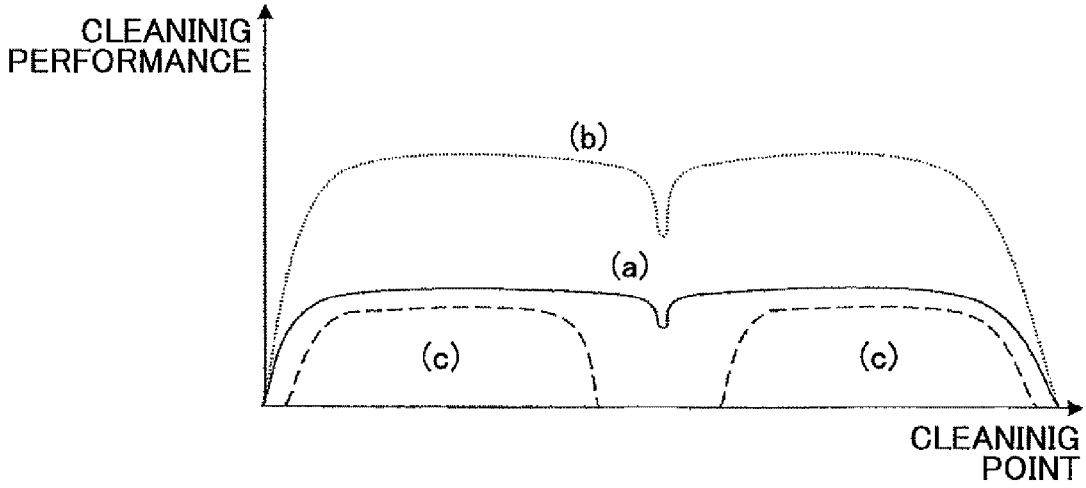
FIG. 9 is graphs illustrating the characteristics of the picture images of FIGS. 8A through 8C.

FIGS. 8A through 8C are picture images of the experimental results in visualizing the cleaning performances of various cleaning chassis. Measurement conditions are the same as those in the cases described above. FIG. 9 illustrates graphs (a) through (c) illustrating the respective cases of FIGS. 8A through 8C.

FIG. 8A illustrates results using the cleaning chassis having two "compact both sides separation 50 mm type" chassis having the following configuration (hereinafter "connecting type").

Outer diameter of chassis 4: 50 mm
Outer diameter of path limiting member 16: 30 mm
Height of chassis 4: 50 mm×2
Size of opening part 18: (W1) 100 mm×(W3) 25 mm
Amount of cleaning media 5: 1 g×2
Path limiting member 16: porous shape FIG. 8B illustrates results using the "connecting type" cleaning chassis with a duct collector having suction capability substantially twice as high as that of the suction unit 6.

FIG. 8C illustrates results using the "connecting type" cleaning chassis using thick flat plane plates as the separation planes 14.

As illustrated in FIG. 8C, when the "connecting type" cleaning chassis using the thick flat plane plates was used, there were observed wide uncleaned areas of the connecting section between the chassis in the 100 mm long region. Namely, uneven cleaning was observed. In other areas, uniform impact points were observed, but the cleaning performance is relatively low.

As illustrated in FIG. 8A, when the "connecting type" cleaning chassis was used, relatively uniform impact points are observed except for the limited area of the connecting section between the chassis in the 100 mm long region.

Further, the path limiting member 16 has a porous shape. Therefore, the area of the separation plates may be increased depending on the length, and more cleaning media 5 were stored in the chassis 4. As a result, no leakage of the cleaning media 5 was observed when the opening parts 18 are separated from the cleaning targets 20.

However, the cleaning performance in the "connecting type" cleaning chassis was less than that in the "compact both sides separation 50 mm type" cleaning chassis due to the increase of the area of the opening parts (i.e., the increase of the areas to be cleaned).

As illustrated in FIG. 8B, in the "connecting type" cleaning chassis having a stronger suction unit, it may be possible to increase the size of the opening parts 18 (i.e., to increase the size of the areas to be cleaned) while maintaining a certain level of the cleaning performance in the 100 mm long region when compared with the cleaning chassis describe with reference to FIGS. 17 through 19.

Figure 10:
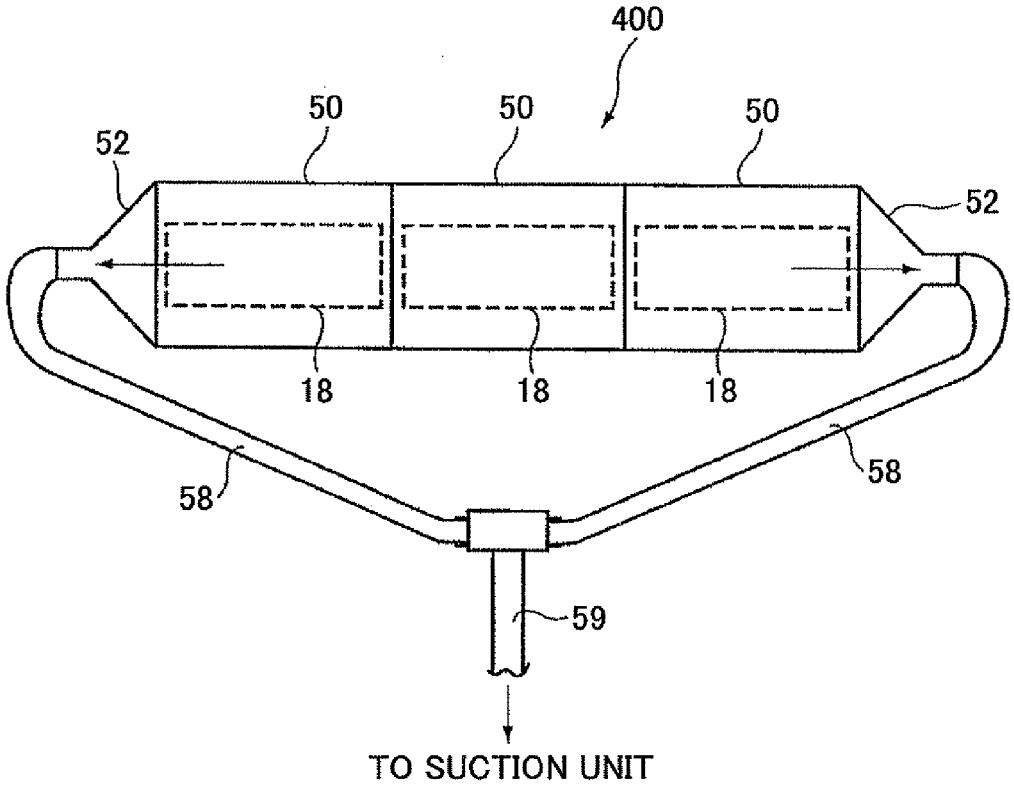
FIG. 10 illustrates a modified example configuration including plural chassis connected to each other.

As illustrated in FIG. 5, when an operator uses the connected chassis 400, the operator holds one side of the connected chassis 400. Therefore, the longer the length of the connected chassis 400 becomes, more difficult the moving operations of the connected chassis 400 becomes. At the same time, the usage and the movability may also be degraded. To overcome the inconveniences, as illustrated in FIG. 10, two suction covers 52 may be provided on the respective edge parts of the connected chassis 400 to form a both sides suction type connected chassis. In this case, pipes 58 having a shape retaining capability are used to combine air from both edge portions of the connected chassis 400, and the pipe 59 is used to transfer the combined air to the suction unit 12.

In the above embodiment, a case is described where plural chassis 50 as the sectional chassis are connected to configure the connected chassis 400. However, there may be provided a chassis 50 having an integrated structure having plural regions having the similar cleaning performed as that described above.

Next, a second embodiment of the present invention is described with reference to FIGS. 11 and 12. As described above, the same reference numerals are used for the elements having the same or equivalent functions as those of the elements described above, and the repeated description may be omitted. In this embodiment, it is the same in that the path limiting member 16 is used as the suction path. However, the configuration in this embodiment differs from that in the first embodiment in that the path limiting member 16 is also used to have the function of the separation plate 14.

Figure 11B:
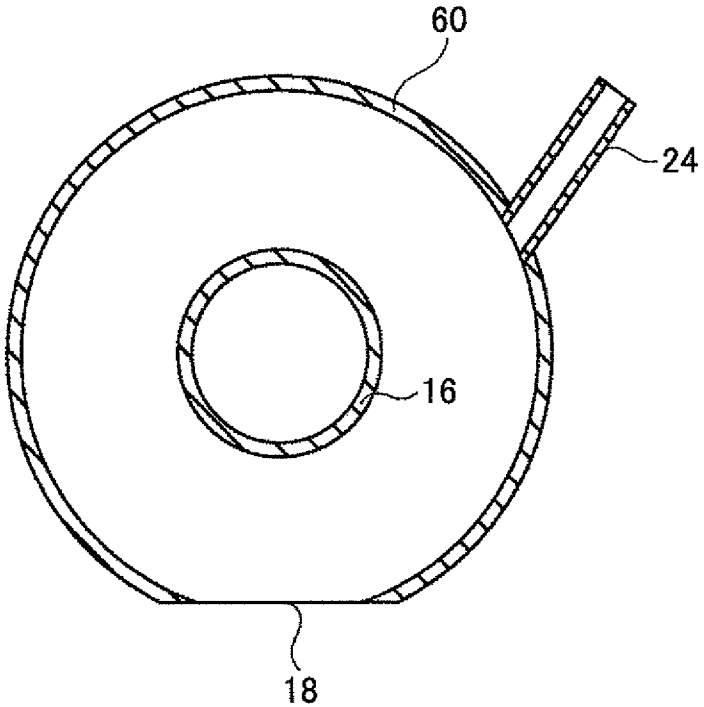
FIGS. 11A and 11B are cross-sectional views of a dry-type cleaning chassis according to a second embodiment of the present invention.
Figure 11A:
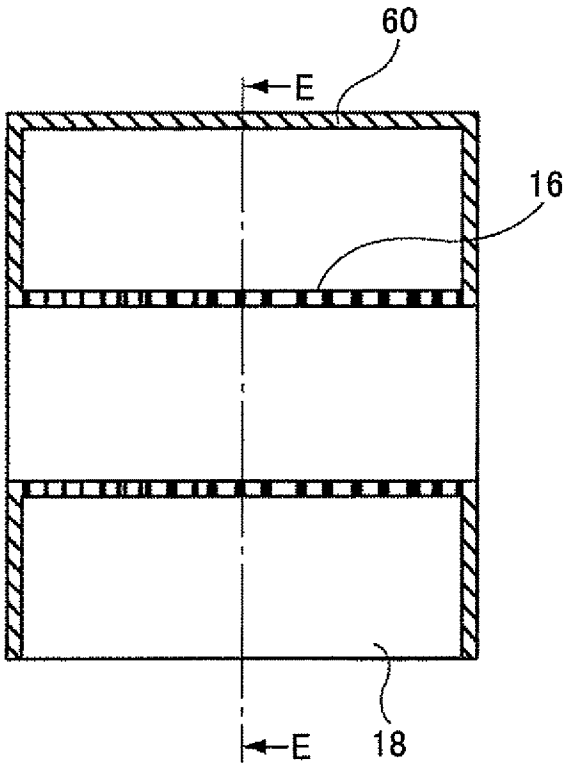

As illustrated in FIG. 11, the chassis 60 includes the path limiting member 16 having a porous shape, so that air can pass through the path limiting member 16 but the cleaning media 2 cannot pass through the path limiting member 16.

Even when the member having the separating function has a conical shape, since the surface of the member is formed along the direction of the circulating flow, the cleaning media may be adsorbed on the surface and flow from the surface of the member across the entire surface along the axis center direction of the chassis 60. Namely, when the length of the chassis 60 is increased in the axis center direction, the distribution of the adsorbed cleaning media 5 may not be biased. Therefore, even cleaning performance may be acquired across the entire width of the opening parts 18 and the leakage of the cleaning media 5 when the opening parts 18 are separated may be prevented.

When plural chassis 60 are connected, it may become possible to increase the area to be cleaned at the same time while maintaining the even cleaning performance similar to the above embodiment. In FIG. 12, the chassis 500 having an integrated structure is illustrated. However, as described in the above embodiment, a method in which plural chassis 60 having the engagement mechanism connected may be used.

Figure 12:
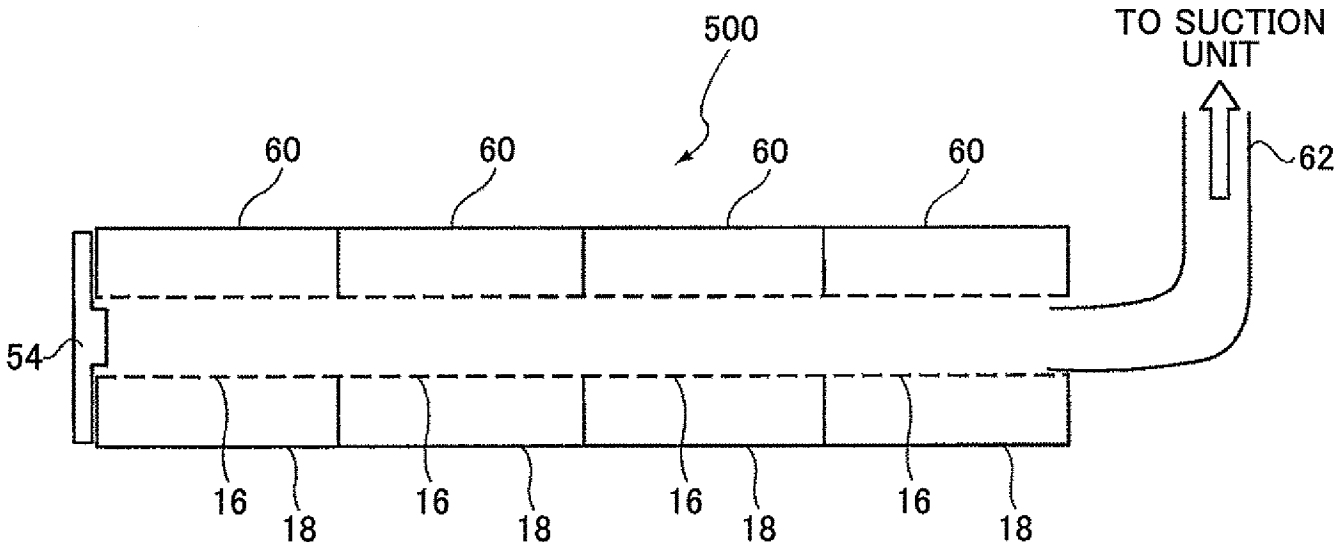
FIG. 12 is a schematic cross-sectional view of a configuration including plural dry-type cleaning chassis connected to each other.

FIG. 12 illustrates a configuration in which one end of a pipe 62 is directly connected to the path limiting member 16 without using the suction cover 52. However, similar to the above embodiment, the pipe 62 may be connected to the path limiting member 16 via the suction cover 52.

The dry-type cleaning chassis in the above embodiment are different from the dry-type cleaning chassis described with reference to FIGS. 17 through 19.

Next, a third embodiment of the present invention is described with reference to FIGS. 13 and 14.

The feature of this embodiment is that both the separation plates 14 and the path limiting members 16 have the porous shape.

Figure 13:
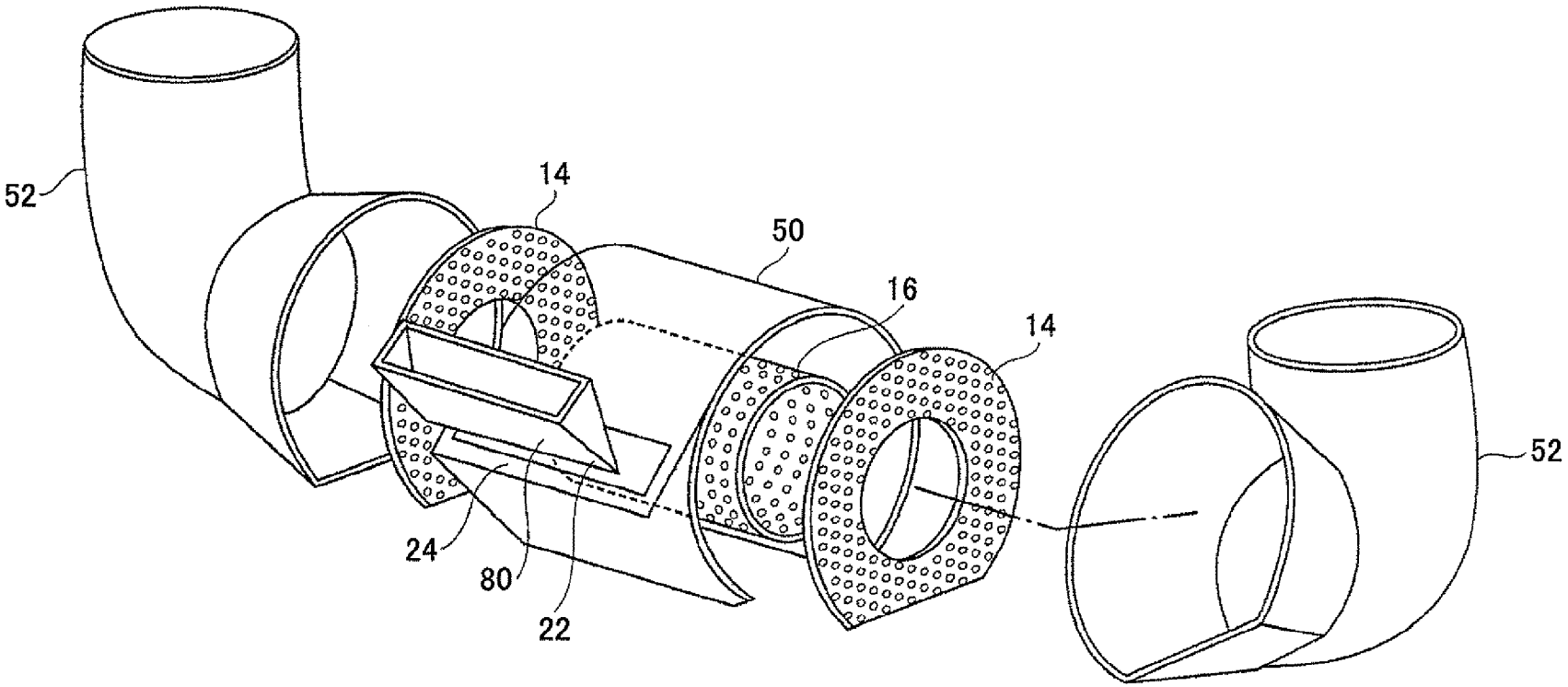
FIG. 13 is an exploded perspective view of a unit of a dry-type cleaning chassis according to a third embodiment of the present invention.
Figure 14:
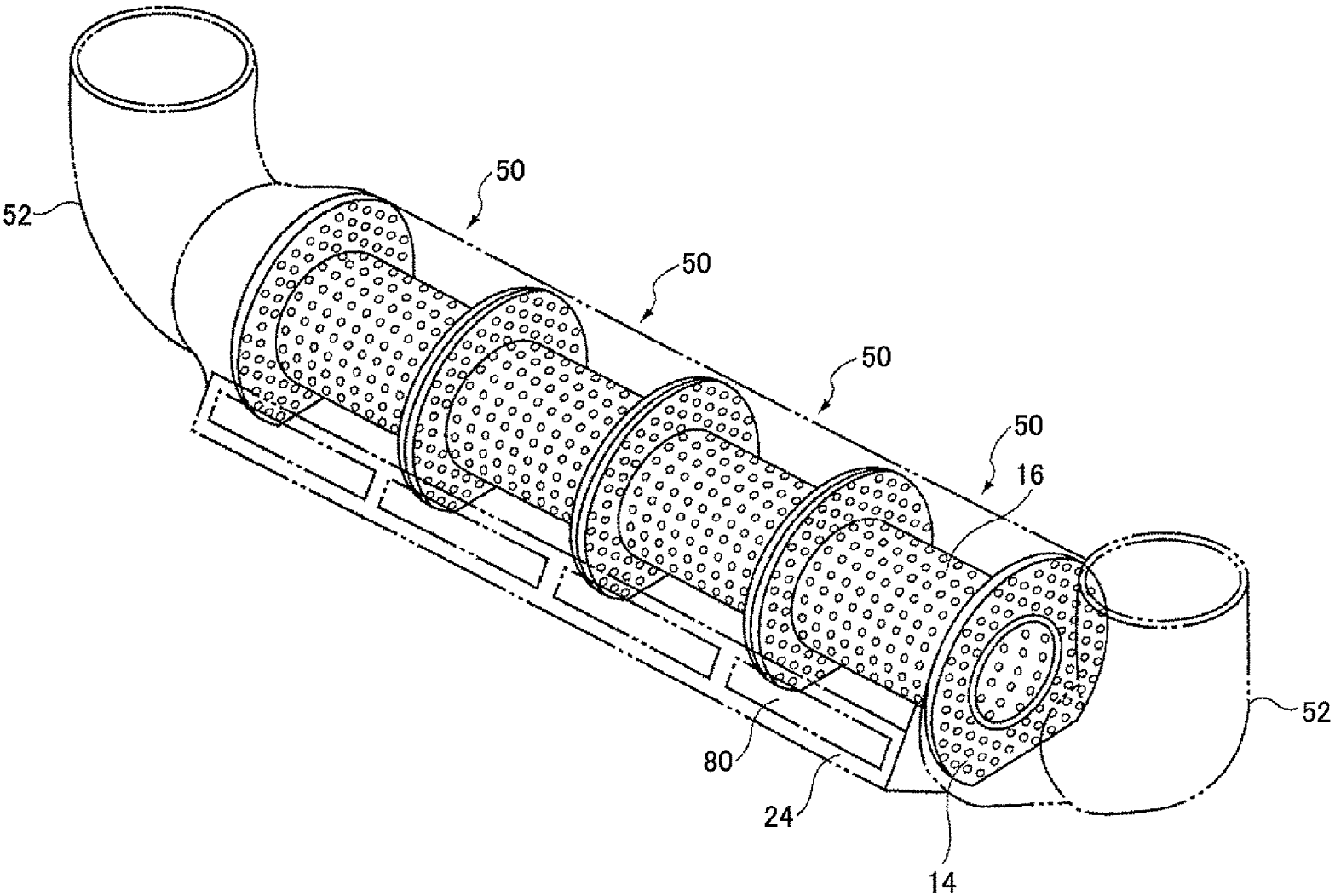
FIG. 14 is an oblique view of a configuration including plural dry-type cleaning chassis connected to each other.

As illustrated in FIG. 13, the separation plates 14 having a flat plate shape are fixed at edge portions of the sectional chassis 50 and the porous path limiting member 16 in the axis center direction, so as to be in communication with the path limiting member 16. Further, an air flow path width changing member 80 changing the width of the air flow path as an air flow path width changing unit is detachably provided at the inlet 24. Practically, plural air flow path width changing members 80 having different areas of the opening are provided, so that an operator may select an appropriate air flow path width changing member 80 in response to a desired air flow rate.

By having the air flow path width changing members 80, the flow speed of the air flowing at the air intake port 22 may be easily optimized.

In this embodiment, a method is described in which, to determine the flow speed of the air flowing at the air intake port 22, plural air flow path width changing members 80 are provided. However, the present invention is not limited to this method. For example, the area of the opening may be changed by adjusting the mechanism (e.g., a valve) provided at the inlet 24.

FIG. 13 illustrates a both sides suction method using a single sectional chassis 50. To increase the areas to be cleaned, as illustrated in FIG. 14, plural sectional chassis 50 may be connected. FIG. 14 illustrates a configuration including four chassis using the both sides suction method.

As described above, both the separation plates 14 and the path limiting members 16 have the porous shape. Therefore, it may become possible to have communication between the adjacent chassis. As a result, the variation of the flow speeds of the circulated air flow among plural chassis may be reduced, and the uneven cleaning may be reduced.

Figure 15B:
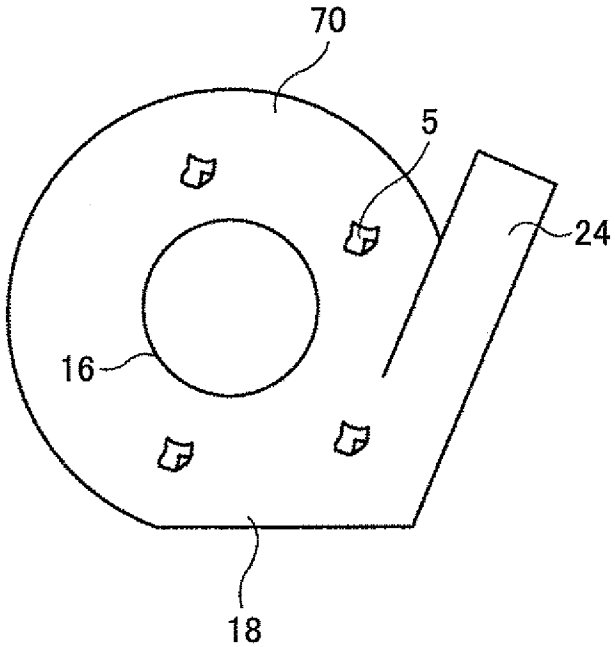
FIGS. 15A and 15B are cross-sectional views of a dry-type cleaning chassis of a comparative example.
Figure 15A:
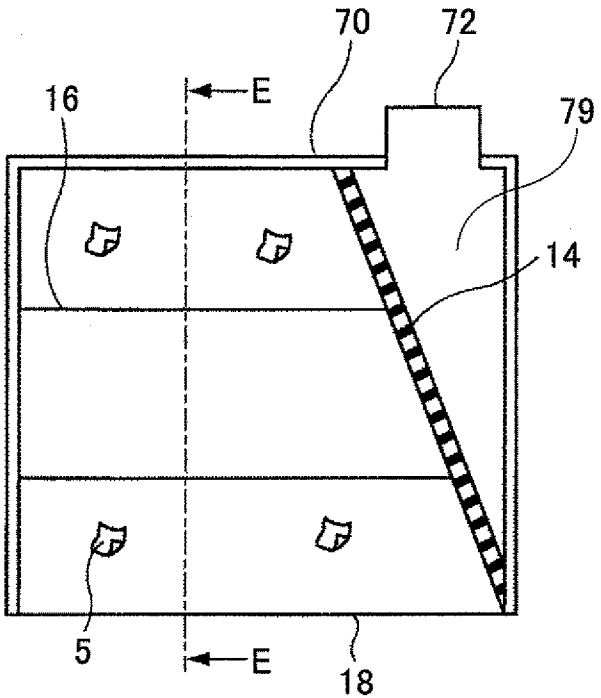
Figure 16:
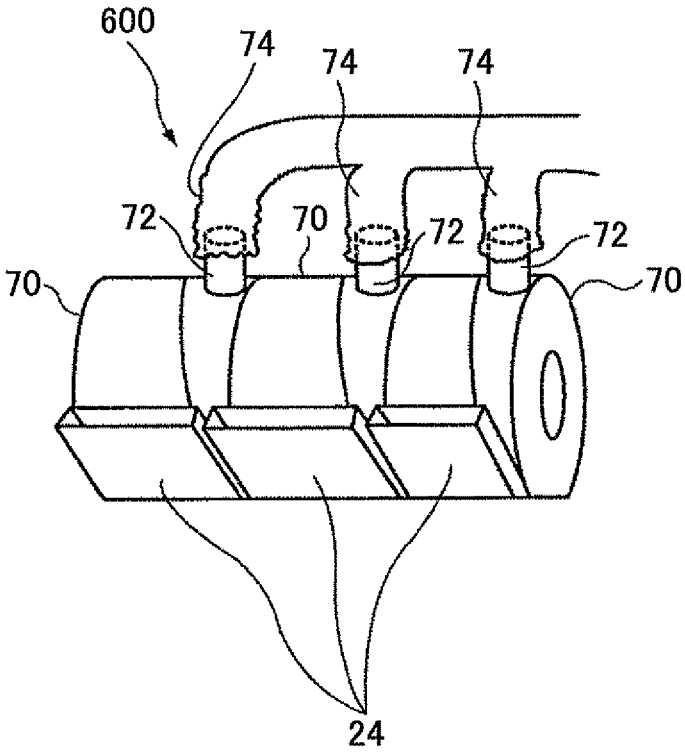
FIG. 16 is a schematic perspective view of a configuration including plural dry-type cleaning chassis of FIGS. 15A and 15B connected to each other.

Next, a configuration which was studied in a process of achieving the present invention is described as a comparative example with reference to FIGS. 15A through 16.

As illustrated in FIGS. 15A and 15B, in the chassis 70 in this example, the separation plate 14 is disposed in an inclined manner, and the suction port 72 is formed on a side surface side of the chassis 70 where the space 79 is formed by the inclined separation plate 14. In this case, the path limiting member 16 does not serve as the suction path.

This configuration is achieved to make it easier to connect plural chassis in the axis center direction to be applied to the chassis described with reference to FIGS. 17 through 19. Namely, by forming the suction port 72 not at the bottom surface of the cylindrical chassis but at the side surface, the interference structure at the connecting section may be removed.

FIG. 16 illustrates the connected chassis 600 based on the sectional chassis 70. However, as illustrated in FIG. 16, the suction port 72 and a suction pipe 74 are provided for each chassis 70. Therefore, in the connected chassis 600, the configuration may become complicated. As a result, may become difficult to handle and operate the connected chassis 600.

On the other hand, however, in the connected chassis 600, it may be easy to increase the areas of the opening parts 18 (i.e., areas to be cleaned at the same time) similar to the chassis of the embodiments described above when compared with the chassis described with reference to FIGS. 17 and 19.

Further, as described above, the material and the size of the cleaning media 5 may be selected depending on the types of the stains on the cleaning targets 20. Next, examples of appropriate cleaning media 5 for removing film-like mattes such as flux attached to the cleaning targets 20 are described.

Figure 25A:
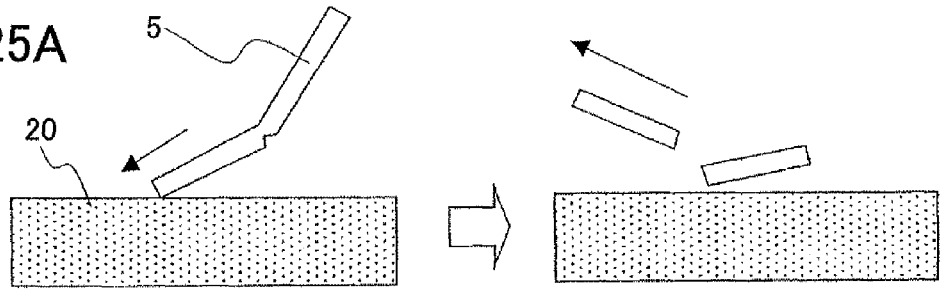
FIG. 25A through 25D are schematic drawings illustrating patterns when slice-shaped cleaning media collide with a cleaning target.
Figure 25B:
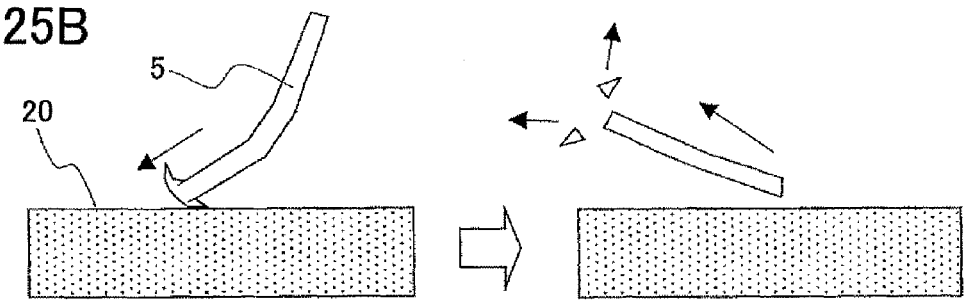
Figure 25C:
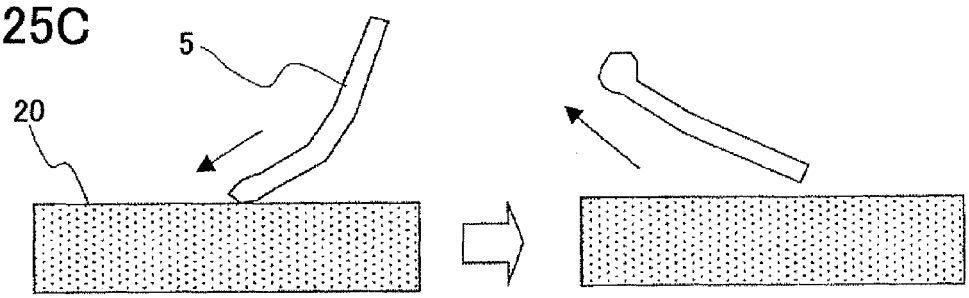

FIGS. 25A through 25D schematically illustrate patterns of the collision of the sliced cleaning media 5. When the cleaning medium 5 is likely to be plastic-deformed (plastically deformed), as illustrated in FIG. 25C, the edge portion of the cleaning medium may be greatly deformed to increase the contacting area and reduce the impact force. As a result, the contacting force at the edge portion of the cleaning medium upon the collision may be dispersed, thereby degrading the cleaning performance. Therefore, the cleaning medium may not sufficiently dig into the matter such as flux, thereby reducing the cleaning efficiency of the cleaning device.

Figure 25D:
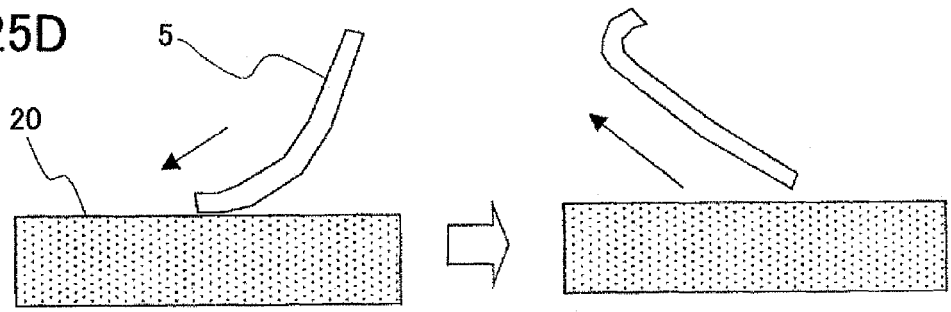

When the cleaning medium 5 is likely to be ductile fractured, as illustrated in FIG. 25D, the plastic deformation of the fractured surface of the cleaning medium may progress to increase the contacting area and reduce the impact force. As a result, the contacting force at the edge portion of the cleaning medium 5 upon the collision may be dispersed, thereby degrading the cleaning performance. Therefore, the cleaning medium 5 may not sufficiently dig into the matter such as flux, thereby reducing the cleaning efficiency of the cleaning device.

On the other hand, when the cleaning medium 5 is likely to undergo a brittle fracture, the plastic deformation of the fractured surface of the cleaning medium 5 may progress less. Therefore, the contacting force at the edge portion of the cleaning medium is unlikely to be dispersed.

Further, even when the film like matter is attached to the edge portion of the cleaning medium 5, by repeatedly undergoing the brittle fracture, new edge portions may be repeatedly formed. As a result, the cleaning efficiency may not be reduced.

The brittle materials include glass chips, ceramic chips, resin film chips made of, for example, acrylic resin, polystyrene, and polylactic acid, and the like.

On the other hand, when a bending force is repeatedly applied to the cleaning medium 5, the cleaning medium 5 may be fractured. In the present invention, whether the cleaning medium is formed of a brittle material is defined based on the folding strength.

When the cleaning media 5 formed of the brittle material have the folding strength less than 65, the burrs generated by the repeated collisions of the cleaning medium 5 may not remain on the cleaning medium 5 but the cleaning medium 5 may be broken and separated (see FIG. 25B). In this case, since the burrs may not remain on the cleaning medium 5, the edge portions of the cleaning medium may be maintained.

Further, when the cleaning medium 5 formed of the brittle material has the folding strength less than 10, the cleaning medium 5 is likely to be broken at the center of the cleaning medium 5 without generating the burr (see FIG. 25A).

Therefore, the edge portions of the cleaning medium 5 may be maintained. Due to the maintained edge portions of the cleaning medium 5, the cleaning medium 5 may sufficiently dig into the matter such as flux. Therefore, the cleaning performance (adhered film removing performance) of the cleaning media 5 may not be reduce over time.

Herein, the term "sliced shape" of the cleaning media 5 refers to a shape having a thickness from 0.02 mm to 0.2 mm and an area equal to or less than 100 $mm^2$.

The term "pencil hardness" refers to the data measured based on the method defined in JIS (Japanese Industrial Standards) K-5600-5-4. The data correspond to the tip number of the hardest pencil that does not damage and bend the tested (evaluated) cleaning medium 5 having the sliced shape.

Further, the term "folding strength" refers to the data measured based on the method defined in JIS P8115. The data correspond to the number of folding times back and force of the evaluated cleaning media having the slice shape at the angle of 135 degrees and with R=0.38 mm.

EXAMPLE

In this example, a pallet formed of epoxy resin including glass fibers, with flux being adhered on the pallet, is used as a sample of the cleaning target. The pallet is used for masking the areas not to be soldered on a PCB in a soldering process using a flow solder bath. When such a masking fixture is repeatedly used, flux may be thickly accumulated in a film formed on the masking fixture. Therefore, it is necessary to periodically remove the flux from the masking fixture. The typical pencil hardness of the adhered flux is 2B, and the thickness of the film-like flux is in a range from 0.5 mm to 1.0 mm.

As the cleaning device, the dry-type cleaning device including the dry-type cleaning chassis as illustrated in FIG. 1 was used. As the suction unit connected to the cleaning device, a device having suction performance of degree of vacuum 20 kPa was used. A pallet on which flux has been adhered was prepared. The area (45 mm×60 mm) of the opening part was defined as one sample unit. Then, the pallet was cleaned for three seconds. The amount of the cleaning media was 2 g for each chassis. The used cleaning media having the spliced shape and the cleaning results are illustrated in Table 1 below.

In Table 1, the meanings of the following symbols are as follows:

x: hardly removed

Δ: remained partially

○: mostly cleaned

◎: well cleaned

–: cleaning media were dissipated and discharged from cleaning bath

As the data indicating the properties of various types of the cleaning media, the folding strength and the pencil hardness are used as illustrated in Table 1.

According to the results of Table 1, when the pencil hardness of the cleaning media is less than 2B which is the pencil hardness of the flux, flux was hardly removed. This is because, when the cleaning media collide with flux, the cleaning media cannot sufficiently dig into the film-like flux to remove the flux.

As described above, the cleaning media are blown up by the air flow and collide with the cleaning targets repeatedly. Due to the repeated collision, damage may be accumulated in the cleaning media. As a result, the cleaning media may be degraded by being fractured or deformed.

Figure 26:
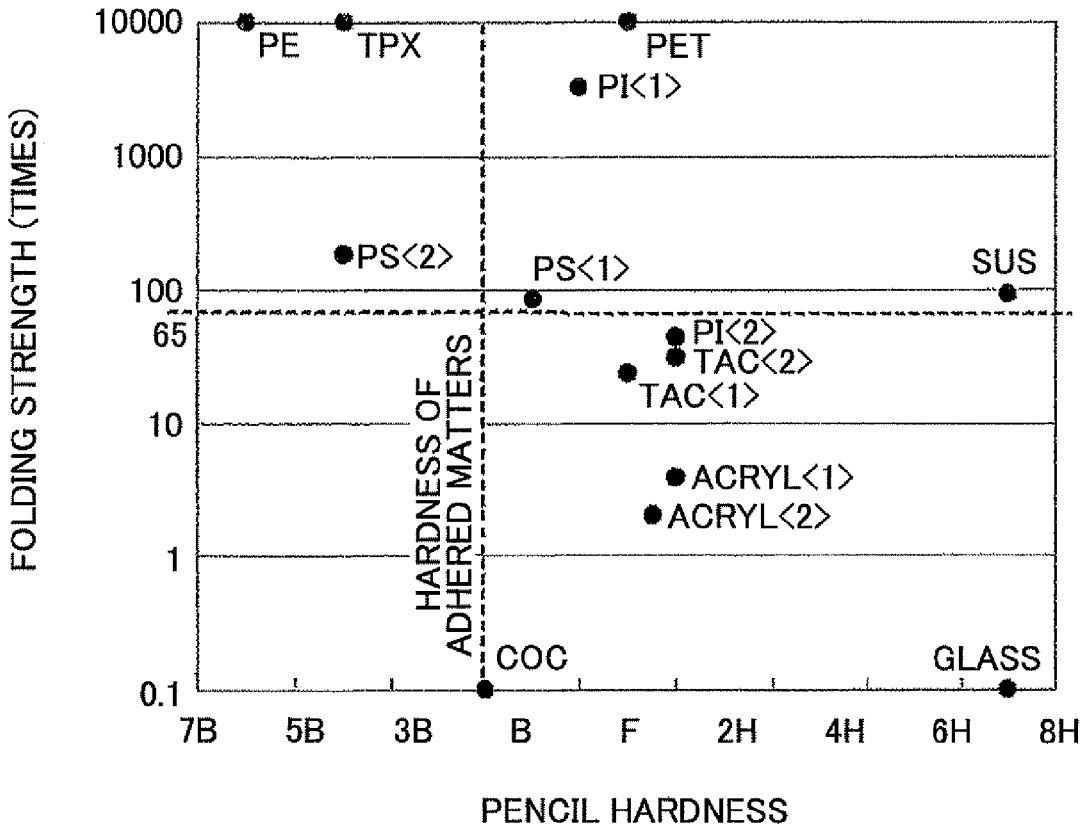
FIG. 26 is a drawing illustrating distribution of mechanical properties of various cleaning media.

Further, FIG. 26 illustrates the mechanical properties (i.e., the folding strength and the pencil hardness) of the various types of the cleaning media.

In the following, the degradation patterns of the cleaning media are described more specifically with reference to Table 1 and FIG. 25. In cases of glass, acryl <1>, acryl <2>, and COC (polyolefin) which are the cleaning media having the folding strength less than 10, as illustrated in FIG. 25A, the cleaning media are broken at the center of the cleaning media due to the impact of the collisions. In this case, however, the broken surfaces become new edge portions of the cleaning media. Therefore, the cleaning performance may not be reduced.

In the cases of TAC (triacetate) <1>, TAC <2>, and PI (polyimide) <2> which are the cleaning media having the folding strength equal to or greater than 10 and less than 65, as illustrated in FIG. 25B, the cleaning media may not be broken at the center of the cleaning media but burrs are generated at the edge portions of the cleaning media due to the impact of the collisions. Then, only the portions of the burrs are broken. Therefore, the thickness of the cleaning media may be maintained, thereby maintaining the capability of removing flux (stains).

In a case where the folding strength of the material of the cleaning media is equal to or greater than 65, the cleaning media may not be broken by the collision but the edge portions of the cleaning media may be plastic deformed.

FIG. 25C illustrates a case where the edge portion is plastic deformed and crushed, so that the end part comes to have a drop shape. This behavior is observed in PI <1>.

FIG. 25D illustrates a case where the edge portion is plastic deformed and curled. This behavior is observed in SUS, PS <1>, PS<2>, PE, PET, TPX.

The cleaning media have the behaviors as illustrated in FIGS. 25C and 25D, due to the plastic deformation of the edge portions, the edge portions coming to have a drop shape. As a result, the impact force upon the collision may be reduced. Therefore, as illustrated in Table 1, after the collisions of the cleaning media with multiple samples, the cleaning performance were greatly reduced.

Based on the results described above, to remove the adhered flux having accumulated in a film form, when the cleaning media having the pencil strength equal to or greater than the pencil strength of the flux and formed of a brittle material having the folding strength equal to or greater than 0 and less than 65 is used, desirable results may be stably obtained for a long time period.

As the bases of the figures used in this embodiment, Tables 1 and 2 illustrate ranges of the folding strength of the various types of the cleaning media.

As illustrated in Tables 1 and 2, the cleaning media having the sliced shape in which the average value or the minimum value of the folding strength is zero (herein e.g., glass, COC, and acryl <2>) are formed of a material which is very brittle against the folding force, and are apt to be dissipated in a short time period. Therefore, the running cost may be increased.

Further, the maximum folding strength of the PI <2> indicating good cleaning performance is 52.

Therefore, when the folding strength of the cleaning media is in a range from 0 to 52, the cleaning media may maintain good cleaning performance for a longer time period.

Further, among the cleaning media indicating the behavior of being brittle fractured (brittlly fractured), the maximum folding strength was 9 of the cleaning media formed of acryl <1>. Therefore, the cleaning media may be classified into two categories. Namely, the cleaning media indicating the holding strength in a range from 0 to 9 may be brittle fractured as illustrated in FIG. 25A. Further, the cleaning media indicating the holding strength in a range from 10 to 52 may be brittle fractured as illustrated in FIG. 25B.

Further, the cleaning media formed of acryl <2> indicating the minimum folding strength is zero are very brittle and could not be used for a long time period as illustrated in Table 1. On the other hand, the cleaning media formed of acryl <1> indicating the minimum folding strength could maintain the cleaning performance for a long time period as illustrated in Table 1.

TABLE 1

| | CLEANING MEDIA | | | | NO OF SAMPLES | |
|---|---|---|---|---|---|---|
| No. | MATERIAL | THICKNESS (μ) | FOLDING STRENGTH | PENCIL HARDNESS | 1 | 30 |
| 1 | POLYOLEFIN | 155 | 0 | B | X | — |
| 2 | GLASS | 100 | 0 | 9H OR MORE | ◎ | — |
| 3 | ACRYL <2> | 125 | 2 | H-F | ○ | — |
| 4 | ACRYL <1> | 125 | 4 | 2H | ○ | ○ |
| 5 | TAC (TRIACETATE) <1> | 120 | 24 | H | ○ | ○ |
| 6 | TAC (TRIACETATE) <2> | 105 | 32 | 2H | ○ | ○ |
| 7 | PI (POLYIMIDE) <2> | 135 | 45 | 2H | ○ | ○ |
| 8 | PS (POLYSTYRENE) <1> | 130 | 88 | HB | Δ | X |
| 9 | SUS (STAINLESS) | 20 | 95 | 9H OR MORE | ◎ | X |
| 10 | PS (POLYSTYRENE) <2> | 150 | 190 | 4B | X | X |
| 11 | PI (POLYIMIDE) <1> | 125 | 3250 | F | Δ | X |
| 12 | PE (POLYETHYLENE) | 100 | 10,000 OR MORE | 6B | X | X |
| 13 | TPX | 100 | 10,000 OR MORE | 4B | X | X |
| 14 | PET | 110 | 10,000 OR MORE | H | Δ | X |

NOTES:

Δ, X: CURL IS GENERATED DUE TO PLASTIC DEFORMATION

X: EDGE PORTION HAS DROP SHAPED DUE TO PLASTIC DEFORMATION

TABLE 2

| No. | MATERIAL | AVERAGE FOLDING STRENGTH | MAXIMUM FOLDING STRENGTH | MINIMUM FOLDING STRENGTH |
|---|---|---|---|---|
| 3 | ACRYL <2> | 2 | 8 | 0 |
| 4 | ACRYL <1> | 4 | 9 | 1 |
| 7 | PI (POLYIMIDE) <2> | 45 | 52 | 41 |
| 8 | PS (POLYSTYRENE) <1> | 88 | 115 | 65 |

According to the average values of the folding strength of the various types of the cleaning media, in order to ensure removal of film-like attached matter such as flux, it may be preferable to use the cleaning media having the pencil strength equal to or greater than the pencil strength of the film-like attached matter and having the folding strength in a range from 2 to 45.

According to an embodiment of the present invention, even when the length of the chassis in the axis center direction is extended, uniform cleaning may be performed, scattering of the cleaning media may be prevented, and the size of the cleaning area may be increased without degrading the cleaning performance.

Further, by connecting plural chassis in the axis center direction, the chassis having a desired length may be easily achieved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A dry-type cleaning chassis for cleaning a cleaning target by colliding cleaning media with the cleaning target, the cleaning media being blown by an air flow, the dry-type cleaning chassis comprising:

a chassis part including an internal space where the cleaning media are to fly;

an opening part configured to be in contact with the cleaning target, so that the cleaning media collide with the cleaning target;

an air inlet duct configured to introduce external air into the internal space;

a suction port provided for generating a circulating air flow in the internal space by suctioning the air having been introduced into the internal space via the air inlet duct;

a porous unit configured to pass objects removed from the cleaning target to a suction port side; and a path limiting member formed of a cylindrical shape extended in an axis center direction of the circulating air flow and configured so that an inside of the cylindrical shape is in communication with the suction port as a suction path, wherein the chassis part is divided into plural regions in the axis center direction, and wherein the plural regions independently contain the cleaning media.

2. The dry-type cleaning chassis according to claim 1, wherein the plural regions are configured as sectional chassis that can be connected to each other in the axis center direction, and a single chassis part is configured by connecting plural of the sectional chassis.

3. The dry-type cleaning chassis according to claim 2, wherein the sectional chassis are connected to each other based on a detachable concave-convex engagement structure.

4. The dry-type cleaning chassis according to claim 2, wherein a suction cover having the suction port is connected to one edge port of the single chassis part, and a termination cover to seal another edge port of the suction path is connected to the other edge port of the single chassis part.

5. The dry-type cleaning chassis according to claim 2, wherein suction covers having the respective suction ports are connected to respective edge ports of the single chassis part in the axis center direction, so that air can be suctioned from both edge portions of the single chassis part in the axis center direction.

6. The dry-type cleaning chassis according to claim 2, wherein the plural sectional chassis are divided by dividing plates serving as plural of the porous units.

7. The dry-type cleaning chassis according to claim 2, wherein the plural sectional chassis are divided by dividing plates having a thin plate shape.

8. The dry-type cleaning chassis according to claim 2, wherein the plural sectional chassis are divided by dividing plates connected to the suction path.

9. The dry-type cleaning chassis according to claim 8, wherein the porous unit has a conical shape so as to be pulled into an inside of the chassis part.

10. The dry-type cleaning chassis according to claim 1, wherein a width of the opening part in the axis center direction is substantially equal to a width of each of the plural regions of the chassis part in the axis center direction.

11. The dry-type cleaning chassis according to claim 1, wherein the porous unit is provided at one edge portion of the path limiting member in the axis center direction, wherein the porous unit provides a connection between an outer border of the one edge portion of the path limiting member in the axis center direction and an inner border of the chassis part, and wherein the porous unit include a continuous surface along a flow of the circulating air flow.

12. The dry-type cleaning chassis according to claim 1, wherein the path limiting member serves as the porous unit.

13. The dry-type cleaning chassis according to claim 1, further comprising:

an air flow path width changing unit configured to change a width of the air inlet duct.

14. A dry-type cleaning device comprising:

the dry-type cleaning chassis according to claim 1;

the cleaning media contained the internal space of the dry-type cleaning chassis; and a suction unit connected to the suction port of the dry-type cleaning chassis.

* * * * *